US007000583B2

(12) United States Patent
Kino et al.

(10) Patent No.: US 7,000,583 B2
(45) Date of Patent: Feb. 21, 2006

(54) INTAKE APPARATUS

(75) Inventors: Hitoshi Kino, Aichi (JP); Takahiro Komori, Aichi (JP); Yoshikazu Hirose, Aichi (JP)

(73) Assignee: Toyoda Gosei Co., Ltd., Aichi-ken (JP)

( * ) Notice: Subject to any disclaimer, the term of this patent is extended or adjusted under 35 U.S.C. 154(b) by 167 days.

(21) Appl. No.: 10/618,853

(22) Filed: Jul. 15, 2003

(65) Prior Publication Data

US 2004/0118371 A1 Jun. 24, 2004

(30) Foreign Application Priority Data

Jul. 16, 2002 (JP) ..... P2002-207237
Sep. 26, 2002 (JP) ..... P2002-280805
Mar. 19, 2003 (JP) ..... P2003-074932

(51) Int. Cl.
*F02M 35/10* (2006.01)

(52) U.S. Cl. ..... 123/184.53; 123/198 E; 181/229

(58) Field of Classification Search ..... 123/198 E, 123/184.42, 184.53, 184.61; 181/229
See application file for complete search history.

(56) References Cited

FOREIGN PATENT DOCUMENTS

JP A-3-279664 12/1991
JP A-2002-021660 1/2002

*Primary Examiner*—Noah P. Kamen
(74) *Attorney, Agent, or Firm*—Posz Law Group, PLC

(57) ABSTRACT

A plurality of transmission ports which are respectively closed by air-permeable members are disposed in at least two members selected from among the intake duct, the air cleaner, and the air cleaner hose in the intake apparatus. Amounts of air permeation of the air-permeable members are set so as to be mutually different in order to tune intake sound generated from the inlet port and transmitted sound generated from each of the air-permeable members. In addition, a cleaner-incorporated member may be accommodated in the air cleaner, the cleaner-incorporated member having one end communicating with one of the intake duct and the air cleaner hose in such a manner as to be separated from an interior of the air cleaner and another end which is open in the interior of the air cleaner. An outer wall of the air cleaner is formed by a dual-use outer wall portion which also serves as an outer wall of the cleaner-incorporated member as well as an exclusive-use outer wall portion for forming only the air cleaner. The outer wall of the air cleaner has at least one transmission port which is formed in such a manner as to extend over the dual-use outer wall portion and the exclusive-use outer wall portion, and which is closed by an air-permeable member.

15 Claims, 23 Drawing Sheets

INTAKE APPARATUS

The present application is based on Japanese Patent Applications No. 2002-207237, 2002-280805 and 2003-074932, which are incorporated herein by reference.

BACKGROUND OF THE INVENTION

1. Field of the Invention

The present invention relates to an intake apparatus for supplying air to an engine, and more particularly, to an intake apparatus which is capable of suppressing noise.

2. Description of the Related Art

A schematic diagram of an intake apparatus is shown in FIG. 23. As shown in the drawing, an air cleaner 100 is comprised of an intake duct 101, a resonator 110, an air cleaner 103, an air cleaner hose 104, a throttle body 105, and an intake manifold 106. The intake air is sucked into the intake duct 101 through an inlet port 102, and is supplied to combustion chambers 109 of an engine through the resonator 110, the air cleaner 103, the air cleaner hose 104, the throttle body 105, and the intake manifold 106.

In the intake apparatus 100, noise which leaks from the inlet port 102 (this noise will be hereafter referred to as intake sound) becomes a problem. The intake sound has a relatively wide frequency range of 1 kHz or more. Further, a plurality of resonance peaks where sound pressure levels are extremely high are interspersed in this frequency range. Accordingly, the intake sound can be suppressed by making the resonance peaks small.

Accordingly, Unexamined Japanese Patent Publication No. 2002-21660 introduces an air cleaner having an air-permeable member. FIG. 24 shows a schematic diagram of the air cleaner disclosed in that publication. It should be noted that portions corresponding to those of FIG. 23 are denoted by the same reference numerals. As shown in the drawing, a portion of a dirty-side bottom wall 111 of the air cleaner 103 is formed by an air-permeable member 112. Of the plurality of resonance peaks, antinodes of standing waves which form the resonance peaks in a relatively low frequency range are located on the dirty side of the air cleaner 103. For this reason, according to the air cleaner 103 disclosed in the publication is capable of suppressing the sound in a relatively low frequency range in the intake sound.

However, according to the intake apparatus 103 disclosed in the publication, it is merely possible to suppress the sound in a relatively low frequency range. Namely, it is merely possible to suppress only part of the sound in a narrow frequency range.

In addition, if the air-permeable member 112 is disposed, noise which is transmitted through the air-permeable member 112 (this noise will be hereafter referred to as transmitted sound) is generated. The transmitted sound leaks to the interior of an engine compartment close to a vehicle compartment. For this reason, it is necessary to suppress the transmitted sound as well in the same way as the intake sound. Specifically, the sound pressure of the intake sound and the sound pressure of the transmitted sound need to be tuned over a wide frequency range. The tuning of the intake sound and the transmitted sound can be effected by adjusting such as the amount of air permeation of the air-permeable member 112.

However, according to the air cleaner 103 disclosed in the publication, a single air-permeable member 112 is merely disposed on the dirty side. For this reason, of the intake sound and the transmitted sound, it is only the sound in a relatively low frequency range that can be tuned. Namely, it is difficult to tune the sound pressure of the intake sound and the sound pressure of the transmitted sound over a wide frequency range.

Further, Unexamined Japanese Patent Publication No. Hei. 3-279664 introduces an intake apparatus having a resonator. FIG. 22 shows a schematic diagram of an air cleaner and its vicinities of the intake apparatus disclosed in the document. As shown in the drawing, an air cleaner 200 is comprised of a dirty-side casing 201, a clean-side casing 206, and an element 207. An intake duct 209 projects from an outer surface of a side wall of the dirty-side casing 201. A quarter tube member 203 communicating with the intake duct 209 is accommodated in the dirty-side casing 201. Portions of a bottom wall and a side wall of the dirty-side casing 201 are formed as a dual-use outer wall portion which also serves as an outer wall of the quarter tube member 203. A connecting tube portion 205 communicating with the interior of the quarter tube member 203 projects from the dual-use outer wall portion 104. A resonator 211 is connected to the connecting tube portion 205. An air cleaner hose 210 projects from an outer surface of a side wall of the clean-side casing 206. The element 207 partitions the air cleaner 200 into the dirty-side casing 201 and the clean-side casing 206.

The intake air flows in the order of the intake duct 209, the quarter tube member 203, the resonator 211, the quarter tube member 203 again, the dirty-side casing 201, the element 207, the clean-side casing 206, and the air cleaner hose 210. The intake air is then supplied to combustion chambers (not shown) of the engine through a throttle body (not shown) and an intake manifold (not shown). Meanwhile, the intake sound is suppressed by the resonator 211.

However, according to the intake apparatus disclosed in that document, a space for disposing the resonator 211 is required. For this reason, the space for mounting other members in the engine compartment is made narrow.

In addition, the resonator 211 is merely capable of suppressing only the sound in relatively medium and high frequency ranges. Namely, the resonator 211 is difficult to suppress the intake sound over a wide frequency range.

SUMMARY OF THE INVENTION

The intake apparatus of the invention has been completed in view of the above-described problems. Accordingly, an object of the invention is to provide an intake apparatus which is capable of tuning the sound pressure of the intake sound and the sound pressure of the transmitted sound over a wide frequency range, and in which the number of assembling steps is small, and the number of component parts is also small.

From the first aspect of the invention, there is provided an intake apparatus including a tubular intake duct having an inlet port for introducing intake air from an outside, an air cleaner disposed downstream of the intake, duct to filter intake air, and an air cleaner hose disposed downstream of the air cleaner and communicating with a combustion chamber of an engine, characterized in that a plurality of transmission ports which are respectively closed by air-permeable members are disposed in at least two members selected from among the intake duct, the air cleaner, and the air cleaner hose, and that amounts of air permeation of the air-permeable members are set so as to be mutually different in order to tune intake sound generated from the inlet port and transmitted sound generated from each of the air-permeable members.

Namely, the intake apparatus of the invention has an intake duct, an air cleaner, and an air cleaner hose. Transmission ports which are respectively closed by air-permeable members are respectively formed in at least two of these members. Namely, the number of air-permeable members disposed is also plural. In addition, the amounts of air permeation of the plurality of air-permeable members are set to mutually different values so that both the sound pressure of the intake sound and the sound pressure of the transmitted sound can be tuned.

According to the intake apparatus of the invention, the amount of air permeation can be optimized in correspondence with the sound pressure distribution for each frequency in wide frequency ranges of the intake sound and the transmitted sound. Namely, the intake sound and the transmitted sound can be tuned finely. Therefore, according to the intake apparatus of the invention, the sound pressure of the intake sound and the sound pressure of the transmitted sound can be freely tuned over a wide frequency range. It should be noted that the term "amount of air permeation" refers to a volume flow rate per unit time.

Preferably, a construction is provided such that the sound pressure of the intake sound is set to be substantially equal to the sound pressure of the transmitted sound. In the case where the inlet port is open to outside the vehicle, the intake sound mainly constitutes one factor of the noise outside the vehicle. On the other hand, the transmission port is open in such as an engine compartment. For this reason, the transmitted sound mainly constitutes one factor of the noise inside the vehicle. Therefore, in order to make small both the noise outside the vehicle and the noise inside the vehicle, it suffices if tuning is effected such that the sound pressure of the intake sound and the sound pressure of the transmitted sound become substantially equal.

Preferably, a construction is provided such that the sound pressure of the intake sound is set to be substantially equal to or greater than the sound pressure of the transmitted sound. For example, in a case where the sound insulation of the engine compartment or the like is low, the transmitted sound is transmitted as it is to the vehicle compartment without being attenuated. In such a case, the noise inside the vehicle becomes easier to suppress if tuning is provided such that the sound pressure of the transmitted sound becomes equal to or less than the sound pressure of the intake sound.

FIG. 25 shows the frequency distribution of the intake sound and the transmitted sound of the intake apparatus in which a single air-permeable member is disposed on the dirty side of the air cleaner as similar to the apparatus shown in FIG. 24. In the drawing, the abscissa indicates the frequency (Hz), and the ordinate indicates the sound pressure level (dB). In addition, the solid line indicates the intake sound, and the dotted line indicates the transmitted sound.

According to this intake apparatus, the sound pressure of the transmitted sound becomes greater than the sound pressure of the intake sound in the frequency ranges A and B. To set the sound pressure of the transmitted sound to a level below the sound pressure of the intake sound, it suffices if the amount of air permeation of the air-permeable member is made small. However, if the amount of air permeation of the air-permeable member is made small, this time the sound pressure of the intake sound becomes large. Furthermore, if tuning is effected by paying attention to only the frequency ranges A and B, drawbacks can possibly occur in that, in the other frequency ranges, the sound pressure of the transmitted sound becomes greater than the sound pressure of the intake sound, or the sound pressure of the transmitted sound becomes excessively smaller than the sound pressure of the intake sound. Thus, it is difficult to effect tuning over a wide frequency range by a single air-permeable member such that the sound pressure of the transmitted sound becomes equal to or greater than the sound pressure of the intake sound.

In contrast, the intake apparatus of this construction has a plurality of air-permeable members. By adjusting the places of disposition, the amounts of air permeation, and the like of the plurality of air-permeable members, the sound pressure of the intake sound and the sound pressure of the transmitted sound can be tuned relatively easily such that the sound pressure of the intake sound becomes substantially equal to or greater than the sound pressure of the transmitted sound. Hence, according to the intake apparatus of this construction, it is possible to suppress the noise outside the vehicle and the noise inside the vehicle with a good balance.

Preferably, in a particular frequency where the sound pressure levels of the intake sound and transmitted sound approach each other most in a frequency range of not less than 40 Hz and not more than 1000 Hz, the sound pressure of the intake sound is set to fall within a range of the sound pressure of the transmitted sound to the sound pressure of the transmitted sound +3 dB.

The reason is that if it is assumed that the noise energy of the intake sound in a case where no air-permeable member is used is 100%, in a case where the air-permeable member is used, the noise energy is distributed into two components of the intake sound and the transmitted sound. In the case where the intake sound and the transmitted sound is equal, the noise energy is distributed into 50% each. In addition, in a case where there is a difference of 3 dB, the intake sound:transmitted sound=2:1. Thus, the noise energy of the intake sound can be suppressed to ⅔ as compared with the case where the air-permeable member is not used. Strictly speaking, since the transmitted sound is closer to the vehicle compartment than the intake sound and is offensive to the ear, as a standard the transmitted sound is set to a level lower than 3 dB than the intake sound.

Preferably, a construction is provided such that the transmission ports are respectively disposed in the intake duct and a dirty side of the air cleaner. It became known from an example which will be described later that if the transmission ports closed by the air-permeable members are respectively disposed in the intake duct and the dirty side of the air cleaner, the sound pressure of the intake sound and the sound pressure of the transmitted sound can be tuned such that the sound pressure of the intake sound becomes substantially equal to or greater than the sound pressure of the transmitted sound. According to the intake apparatus of this construction, it is possible to suppress more simply the noise outside the vehicle and the noise inside the vehicle with a good balance.

Preferably, a construction is provided such that the amounts of air permeation of the air-permeable members are set such that the amount of air permeation of the air-permeable member disposed on an upstream side becomes greater than the amount of air permeation of the air-permeable member disposed on a downstream side.

Namely, in this construction, the amounts of air permeation of the air-permeable members are set such that the upstream side is greater than the downstream side. It became known from the example which will be described later that if the amounts of air permeation are set such that the upstream side is greater than the downstream side, the sound pressure of the intake sound and the sound pressure of the transmitted sound can be tuned such that the sound pressure of the intake sound becomes substantially equal to or greater than the sound pressure of the transmitted sound. According to the intake apparatus of this construction, it is possible to suppress more simply the noise outside the vehicle and the noise inside the vehicle with a good balance.

From the second aspect of the invention, there is provided an intake apparatus including a tubular intake duct having an inlet port for introducing intake air from an outside, an air cleaner disposed downstream of the intake duct to filter intake air, and an air cleaner hose disposed downstream of the air cleaner and communicating with a combustion chamber of an engine, characterized in that a cleaner-incorporated member is accommodated in the air cleaner, the cleaner-incorporated member having one end communicating with one of the intake duct and the air cleaner hose in such a manner as to be separated from an interior of the air cleaner and another end which is open in the interior of the air cleaner, that an outer-wall of the air cleaner is formed by a dual-use outer wall portion which also serves as an outer wall of the cleaner-incorporated member as well as an exclusive-use outer wall portion for forming only the air cleaner, and that the outer wall of the air cleaner has at least one transmission port which is formed in such a manner as to extend over the dual-use outer wall portion and the exclusive-use outer wall portion, and which is closed by an air-permeable member.

The extended parts of at least one of the intake duct and the an air cleaner hose into the inside of the air cleaner is engaged with the cleaner-incorporated member, and the aforementioned transmission port formed in the outer wall portion of the air cleaner may correspond to one of the transmission ports according to the first aspect, which may be disposed among the intake duct, the air cleaner, and the air cleaner hose.

The intake apparatus of the invention has an intake duct, an air cleaner, and an air cleaner hose. A cleaner-incorporated member is accommodated inside the air cleaner. One end of the cleaner-incorporated member communicates with the intake duct or the air cleaner hose. Further, the one end of the cleaner-incorporated member is separated from the interior of the air cleaner. On the other hand, the other end of the cleaner-incorporated member is open in the interior of the air cleaner. An outer wall of the air cleaner is formed by a dual-use outer wall portion which also serves as an outer wall of the cleaner-incorporated member as well as an exclusive-use outer wall portion for forming only the air cleaner. A transmission port is formed in such a manner as to extend over the dual-use outer wall portion and the exclusive-use outer wall portion. This transmission port is closed by an air-permeable member.

The cleaner-incorporated member of the intake apparatus of the invention has the functions of a downstream end portion of the intake duct and an upstream end portion of the air cleaner hose in the conventional intake apparatus. For this reason, in the intake apparatus of the invention, the lengths of the intake duct and the air cleaner hose can be shorter by the portion of the length of the cleaner-incorporated member. Accordingly, the intake apparatus of the invention excels in the space saving characteristic.

In addition, according to the intake apparatus of the invention, the air-permeable member is disposed at a position where antinodes of standing waves of the intake sound are present. For this reason, the intake sound can be suppressed over a wide frequency range.

In addition, the transmission port is formed in such a manner as to extend over the dual-use outer wall portion and the exclusive-use outer wall portion. The cleaner-incorporated member is disposed on an inner side of the dual-use outer wall portion. For this reason, of the transmission port, the portion which is formed in the dual-use outer wall portion functions as the transmission port exclusively used for the cleaner-incorporated member. On the other hand, the cleaner-incorporated member is not disposed on the inner side of the exclusive-use outer wall portion. For this reason, of the transmission port, the portion which is formed in the exclusive-use outer wall portion functions as the transmission port exclusively used for the air cleaner. Namely, the transmission port of the intake apparatus of the invention has both a portion which functions to be used for the cleaner-incorporated member and a portion which functions to be used for the air cleaner. For this reason, the air-permeable member which closes the transmission port also has both the portion which functions to be used for the cleaner-incorporated member and the portion which functions to be used for the air cleaner.

Here, the cleaner-incorporated member communicates with the intake duct or the air cleaner hose, as described above. Accordingly, of the air-permeable member, the portion which functions to be used for the cleaner-incorporated member functions to be used for the intake duct or the air cleaner hose. Hence, according to the intake apparatus of the invention, it is unnecessary to dispose air-permeable members by forming transmission ports in the respective members of the air cleaner, the intake duct, and the air cleaner hose. For this reason, the number of assembling steps is small, and the number of component parts is also small.

Preferably, a construction may be provided such that the cleaner-incorporated member is a semicylindrical member obtained by half-splitting a tubular member in an axial direction, one axial end of the semicylindrical member communicates with one of the intake duct and the air cleaner hose in such a manner as to be separated from the interior of the air cleaner, and another axial end thereof is open in the interior of the air cleaner.

Namely, in this construction, a semicylindrical member is disposed as the cleaner-incorporated member. One axial end of the semicylindrical member communicates with the intake duct or the air cleaner hose. The one axial end of the semicylindrical member is separated from the interior of the air cleaner.

Meanwhile, the other axial end of the semicylindrical member is open in the interior of the air cleaner. As the semicylindrical member is merely disposed with their circumferential both ends abutting against the outer wall of the air cleaner, the interior of the semicylindrical member can be separated in the radial direction from the interior of the air cleaner. For this reason, according to this construction, the air-permeable member can be partitioned relatively easily into the portion which functions to be used for the air cleaner and the portion-which functions to be used for the cleaner-incorporated member (for the intake duct or the air cleaner hose).

Preferably, a construction is provided such that the semicylindrical member is welded and fixed to the dual-use outer wall portion and the air-permeable member. According to this construction, in comparison with a case where the semicylindrical member is fixed by such as fitting, the semicylindrical member can be fixed relatively securely. In addition, according to this construction, it is easy to secure a sealing characteristic of the fixed portion.

Preferably, the intake apparatus is so constructed as to further include a sound shielding wall spaced apart from the air-permeable member closing the transmission port. Namely, in this construction, the sound shielding wall is disposed on the outer side of the air-permeable member. According to this construction, the transmitted sound which was transmitted through the air-permeable member is reflected by the sound shielding wall and the air-permeable member. At the time of reflection, the energy of the transmitted sound is absorbed by the sound shielding wall and the air-permeable member. As a result of this absorption, the transmitted sound is attenuated. The transmitted sound thus attenuated is diffused to outside the air cleaner.

According to this construction, it is possible to suppress not only the intake sound but also the transmitted sound. In addition, according to this construction, the space for installing the sound shielding wall can be made small as compared with the case where sound shielding walls are disposed in the respective members of the air cleaner, the intake duct, and the air cleaner hose. Further, as compared with the case where the sound shielding walls are disposed in the respective members, the number of component parts can be small.

From the third aspect of the invention, there is provided an intake apparatus comprising a tubular intake duct having an inlet port for introducing intake air from an outside, an air cleaner disposed downstream of the intake duct to filter intake air, and an air cleaner hose disposed downstream of the air cleaner and communicating with a combustion chamber of an engine, characterized by further comprising: a cleaner-incorporated member having one end communicating with one of the intake duct and the air cleaner hose in such a manner as to be separated from an interior of the air cleaner and another end which is open in the interior of the air cleaner; a sound shielding wall portion formed integrally with an outer wall of the air cleaner to compartmentalize a sound shielding chamber on an inner side thereof; a communicating port for allowing the sound shielding chamber and an outside of the air cleaner to communicate with each other; and a transmission port for allowing the sound shielding chamber to communicate with the interior of the air cleaner and an interior of the cleaner-incorporated member, the transmission port being closed by an air-permeable member.

The extended parts of at least one of the intake duct and the an air cleaner hose into the inside of the air cleaner is engaged with the cleaner-incorporated member, and the aforementioned transmission port formed in the outer wall port ion of the air cleaner may correspond to one of the transmission ports according to the first aspect, which may be disposed among the intake duct, the air cleaner, and the air cleaner hose.

One end of the cleaner-incorporated member communicates with the intake duct or the air cleaner hose. Further, the one end of the cleaner-incorporated member is separated from the interior of the air cleaner. The other end of the cleaner-incorporated member is open in the interior of the air cleaner.

The sound shielding wall portion is formed integrally with an outer wall of the air cleaner. A sound shielding chamber is disposed on an inner side of the sound-shielding wall portion. The sound shielding chamber and the outside of the air cleaner communicate with each other through a communicating hole. The sound shielding chamber, the interior of the air cleaner, and the interior of the cleaner-incorporated member are separated from each other. Of these portions, the air-permeable member is interposed between the sound shielding chamber and the interior of the air cleaner and between the sound shielding chamber and the interior of the cleaner-incorporated member.

The transmitted sound from the interior of the air cleaner is released from inside the air cleaner to outside the air cleaner through the air-permeable member (transmission port), the sound shielding chamber, and the communicating port. Similarly, the transmitted sound from the interior of the cleaner-incorporated member is released from inside the cleaner-incorporated member to outside the air cleaner through the air-permeable member (transmission port), the sound shielding chamber, and the communicating port.

Here, the transmitted sound which flowed into the sound shielding chamber is reflected by such as the sound shielding wall and the air-permeable member. At the time of reflection, the energy of the transmitted sound is absorbed by such as the sound shielding wall and the air-permeable member. As a result of this absorption, the transmitted sound is attenuated. The transmitted sound thus attenuated is released from the sound shielding chamber to outside the air cleaner through the communicating port.

According to the intake apparatus of the invention, it is possible to suppress not only the intake sound but also the transmitted sound. In addition, according to the intake apparatus of the invention, the space for installing the sound shielding chamber can be made small as compared with the case where sound shielding chambers are disposed in the respective members of the air cleaner, the intake duct, and the air cleaner hose. Further, as compared with the case where the sound shielding chambers are disposed in the respective members, the internal configurations of the respective members can be simplified. In addition, the number of component parts can be small as compared with the case where the sound shielding chambers are disposed in the respective members. Furthermore, the sound-shielding wall portion is formed integrally with the outer wall of the air cleaner. The number of component parts can be small in this respect as well.

In addition, the cleaner-incorporated member of the intake apparatus of the invention has the functions of a downstream end portion of the intake duct and an-upstream end portion of the air cleaner hose in the conventional intake apparatus. For this reason, in the intake apparatus of the invention, the lengths of the intake duct and the air cleaner hose can be shorter by the portion of the length of the cleaner-incorporated member. Accordingly, the intake apparatus of the invention excels in the space saving characteristic.

In addition, according to the intake apparatus the invention, the air-permeable member is disposed at a position where antinodes of standing waves of the intake sound are present. For this reason, the intake sound can be suppressed over a wide frequency range.

In addition, the air-permeable member has both the portion which functions to be used for the cleaner-incorporated member and the portion which functions to be used for the air cleaner. The cleaner-incorporated member communicates with the intake duct or the air cleaner hose, as described above. Accordingly, of the air-permeable member, the portion which functions to be used for the cleaner-incorporated member functions to be used for the intake duct or the air cleaner hose. For this reason, according to the intake apparatus of the invention, it is unnecessary to dispose air-permeable members in the respective members of the air cleaner, the intake duct, and the air cleaner hose. Hence, the number of assembling steps is small, and the number of component parts is also small.

Preferably, a construction is provided such that the transmission port is formed in the sound-shielding wall portion. The sound-shielding wall portion is adjacent to the sound shielding chamber. Hence, according to this construction, the structure of the air cleaner is simplified as compared with a case where the transmission port is disposed in a portion other than the sound-shielding wall portion.

Preferably, a construction is provided such that the cleaner-incorporated member is a half-split member obtained by half-splitting a tubular member in an axial direction, one axial end of the half-split member communicates with one of the intake duct and the air cleaner hose in such a manner as to be separated from the interior of the air cleaner, and another axial end thereof is open in the interior of the air cleaner.

Namely, in this construction, a half-split member is disposed as the cleaner-incorporated member. One axial end of the half-split member communicates with the intake duct or the air cleaner hose. The one axial end of the half-split member is separated from the interior of the air cleaner. Meanwhile, the other axial end of the half-split member is open in the interior of the air cleaner. As the half-split member is merely disposed with their split ends abutting against the air-permeable member, the interior of the half-split member can be separated from the interior of the air cleaner. For this reason, according to this construction, the air-permeable member can be partitioned relatively easily into the portion which functions to be used for the air cleaner and the portion which functions to be used for the cleaner-incorporated member (for the intake duct or the air cleaner hose).

Although several apparatus are independently explained in the above, each of characteristics of each apparatus can be combined and realized in one intake apparatus wherever possible as occasion demands.

DETAILED DESCRIPTION OF THE PREFERRED EMBODIMENTS

Hereafter, a description will be given of the embodiments of the intake apparatus in accordance with the invention.

(1) First Embodiment

Figure 1:
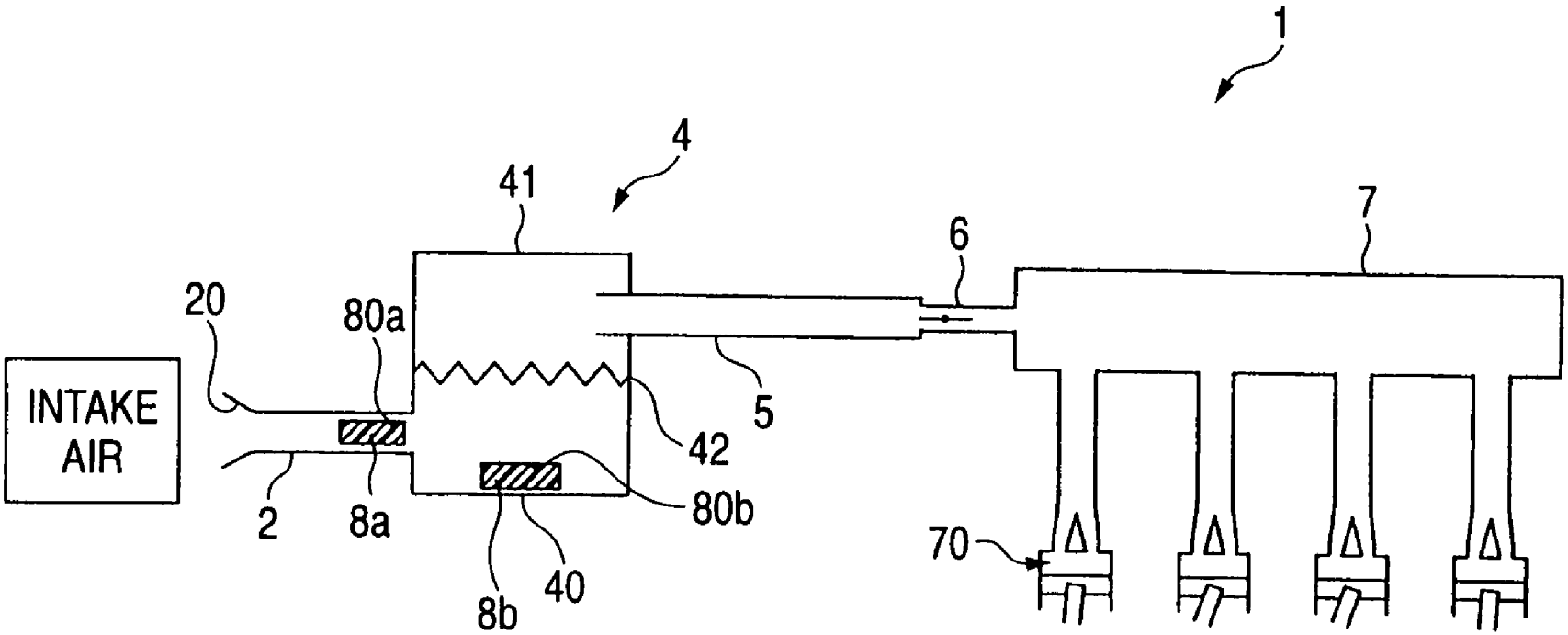
FIG. 1 is a schematic diagram of an intake apparatus in accordance with a first embodiment.

First, a description will be given of the construction of the intake apparatus in accordance with a first embodiment. FIG. 1 shows a schematic diagram of the intake apparatus in accordance with this embodiment. As shown in the drawing, an intake apparatus 1 is comprised of an intake duct 2, an air cleaner 4, and an air cleaner hose 5, a throttle body 6, and an intake manifold 70.

Figure 2:
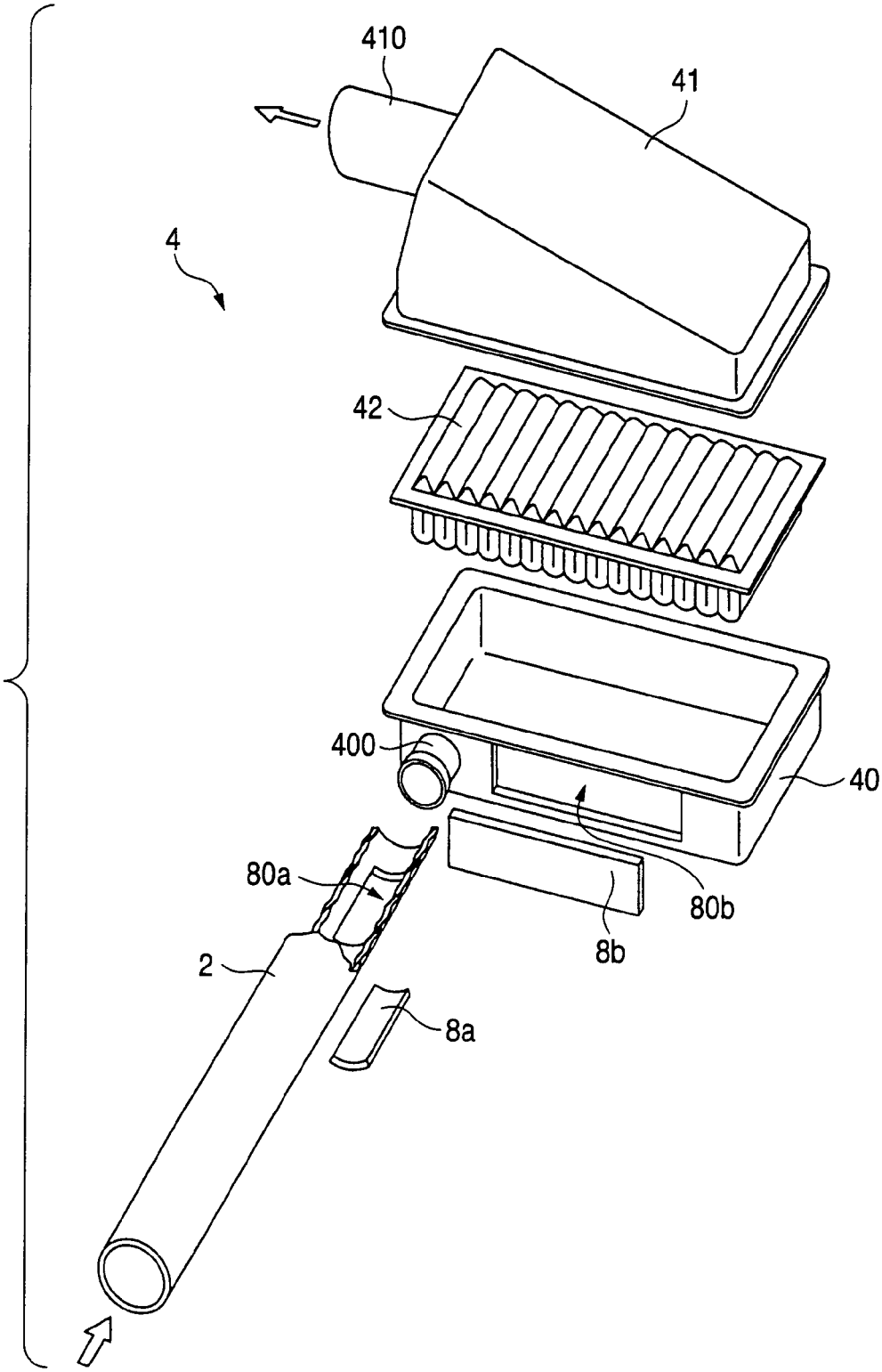
FIG. 2 is an exploded view of an intake duct and an air cleaner of the intake apparatus in accordance with the first embodiment.

The intake duct 2 is made of polypropylene (PP) and has a semicylindrical shape. The intake duct 2 communicates with the outside of the vehicle through an inlet port 20 provided at an upstream end. FIG. 2 shows an exploded view of the intake duct and the air cleaner. As shown in the drawing, a rectangular transmission port 80*a* is formed in a side peripheral wall of the intake duct 2. The transmission port 80*a* is closed by a rectangular plate-shaped air-permeable member 8*a* which is formed of a polyethylene terephthalate (PET) nonwoven fabric.

The air cleaner 3 has a dirty-side casing 40, a clean-side casing 41, and an element 42. Returning to FIG. 2, the dirty-side casing 40 is made of PP with talc mixed in, and has the shape of an upwardly open box. A duct connecting tube 400 projects from a side wall of the dirty-side casing 40. The duct connecting tube 400 is connected to a downstream end of the intake duct 2. In addition, a transmission port 80*b* is formed in the side wall of the dirty-side casing 40. The transmission port 80*b* is closed by a rectangular plate-shaped air-permeable member 8*b* which is formed of a PET nonwoven fabric. It should be noted that the amount of air permeation of the air-permeable member 8*b* is set to be smaller than that of the air-permeable member 8*a*.

The clean-side casing 41 is made of PP with talc mixed in, and has the shape of a downwardly open box. The clean-side casing 41 is disposed above the dirty-side casing 40 in a state in which its opening faces down. A hose connecting tube 410 projects from a side wall of the clean-side casing 41.

The element 42 has the shape of a rectangular plate and is formed by tuck weaving a polyethylene terephthalate (PET) nonwoven fabric. The element 42 is clamped and fixed between opening edges of the dirty-side casing 40 and opening edges of the clean-side casing 41. Further, the element 42 partitions the closed space formed by the dirty-side casing 40 and the clean-side casing 41 into two upper and lower chambers.

Returning to FIG. 1, the air cleaner hose 5 is made of chloroprene (CR) rubber and has a bellows tube shape. An upstream end of the air cleaner hose 5 is connected to the hose connecting tube shown in FIG. 2. An upstream end of the tubular throttle body 6 is connected to a downstream end of the air cleaner hose 5. The intake manifold 7, which is branch-connected to combustion chambers 70, is connected to a downstream end of the throttle body 6. The air sucked into the inlet port 20 from the outside passes the interior of the intake apparatus 1 in the order of the intake duct 2, the dirty-side casing 40, the element 42, the clean-side casing 41, the air cleaner hose 5, the throttle body 6, and the intake manifold 7, and flows into the combustion chambers 70.

Next, a description will be given of the effects of the intake apparatus of this embodiment. A total of two transmission ports 80*a* and 80*b* are formed in the intake apparatus 1 of this embodiment. In addition, the transmission ports 80*a* and 80*b* are respectively closed by the air-permeable members 8*a* and 8*b*. In addition, the amounts of air permeation of the air-permeable members 8*a* and 8*b* are set such that the amount of air permeation of the air-permeable member 8*a* becomes greater than the amount of air permeation of the air-permeable member 8*b*. For this reason, according to the intake apparatus 1 of this embodiment, the amount of air permeation can be optimized in correspondence with the sound pressure distribution for each frequency in the wide frequency ranges of the intake sound and the transmitted sound. Thus, the intake sound and the transmitted sound can be tuned finely.

In addition, the transmission port 80*a* and the transmission port 80*b* are respectively formed in the intake duct 2 and the dirty-side casing 40 of the air cleaner 4. For this reason, according to the intake apparatus 1 of this embodiment, it is possible to tune the intake sound and the transmitted sound such that the sound pressure of the intake sound becomes substantially equal to or greater than the sound pressure of the transmitted sound. Hence, according to the intake apparatus 1 of this embodiment, it is possible to suppress the noise outside the vehicle and the noise inside the vehicle with a good balance.

In addition, the two transmission ports 80*a* and 80*b* are both disposed upstream of the element 42. For this reason, even if dust is mixed in the intake apparatus 1 through the air-permeable members 8*a* and 8*b*, the element 42 is capable of filtering the dust.

(2) Second Embodiment

The difference between a second embodiment and the first embodiment lies in that the transmission ports are respectively disposed in the intake duct and the clean-side casing of the air cleaner. Therefore, a description will be given herein of only the difference.

Figure 3:
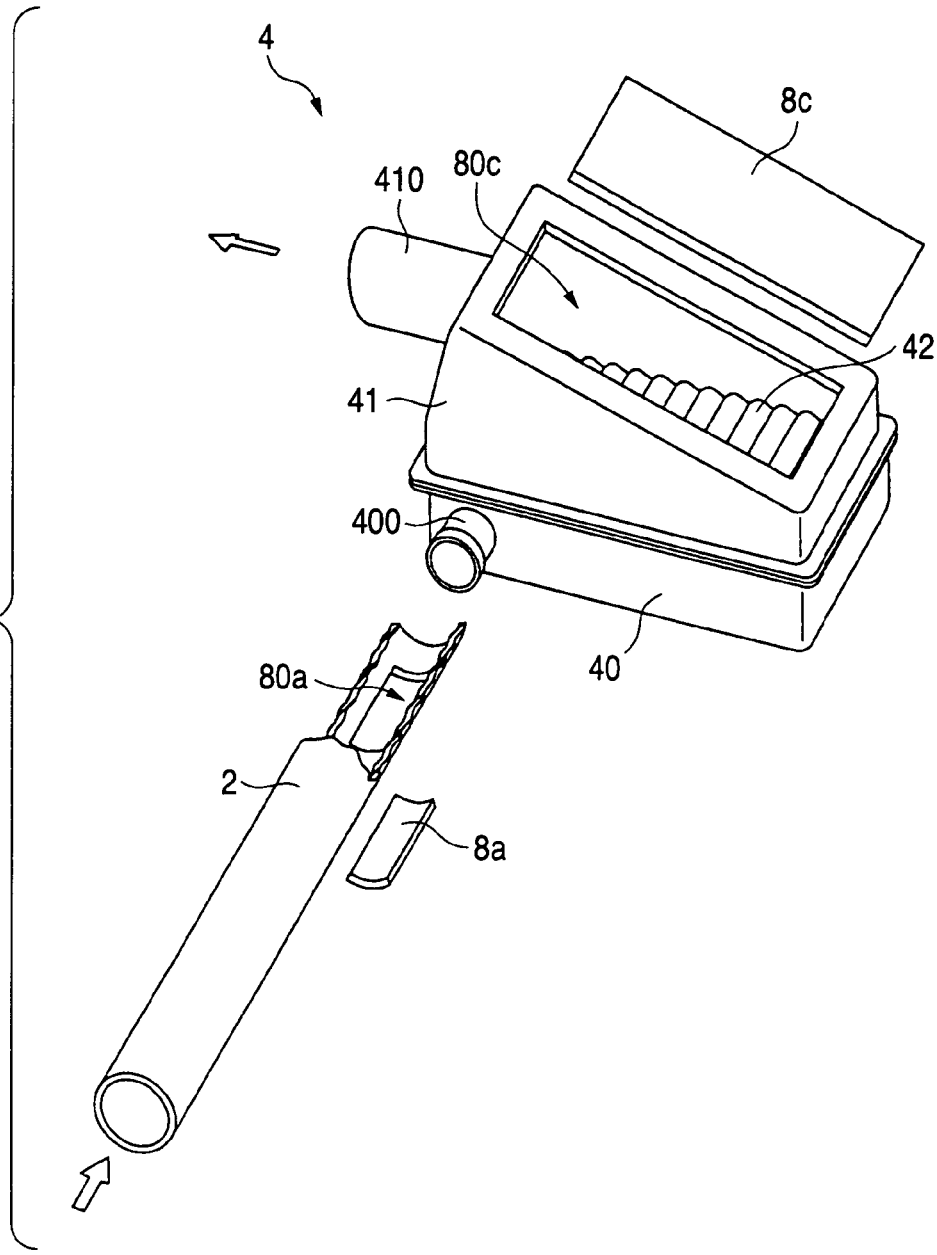
FIG. 3 is a fragmentary exploded view of the intake duct and the air cleaner of the intake apparatus in accordance with a second embodiment.

FIG. 3 shows a fragmentary exploded view of the intake duct and the air cleaner of the intake apparatus in accordance with this embodiment. It should be noted that portions corresponding to those of FIG. 2 will be denoted by the same reference numerals. As shown in the drawing, the transmission port 80*a* is formed in the side peripheral wall of the intake duct 2. The transmission port 80*a* is closed by the air-permeable member 8*a*. In addition, a transmission port 80*c* is formed in an upper wall of the clean-side casing 41 of the air cleaner 4. The transmission port 80*c* is closed by an air-permeable member 8*c*.

According to the intake apparatus 1 of this embodiment, the sound pressure of the intake sound and the sound pressure of the transmitted sound can be freely tuned over a wide frequency range. In addition, according to the intake apparatus 1 of this embodiment, the transmission port 80*c* is disposed downstream of the element 42. Accordingly, the inner surface of the air-permeable member 8*c* is constantly in contact with clean intake air. For this reason, the inner surface side of the transmission port 8*c* is unlikely to be clogged.

(3) Third Embodiment

The difference between a third embodiment and the first embodiment lies in that the transmission ports are respectively disposed in the intake duct and the air cleaner hose. Therefore, a description will be given herein of only the difference.

Figure 4:
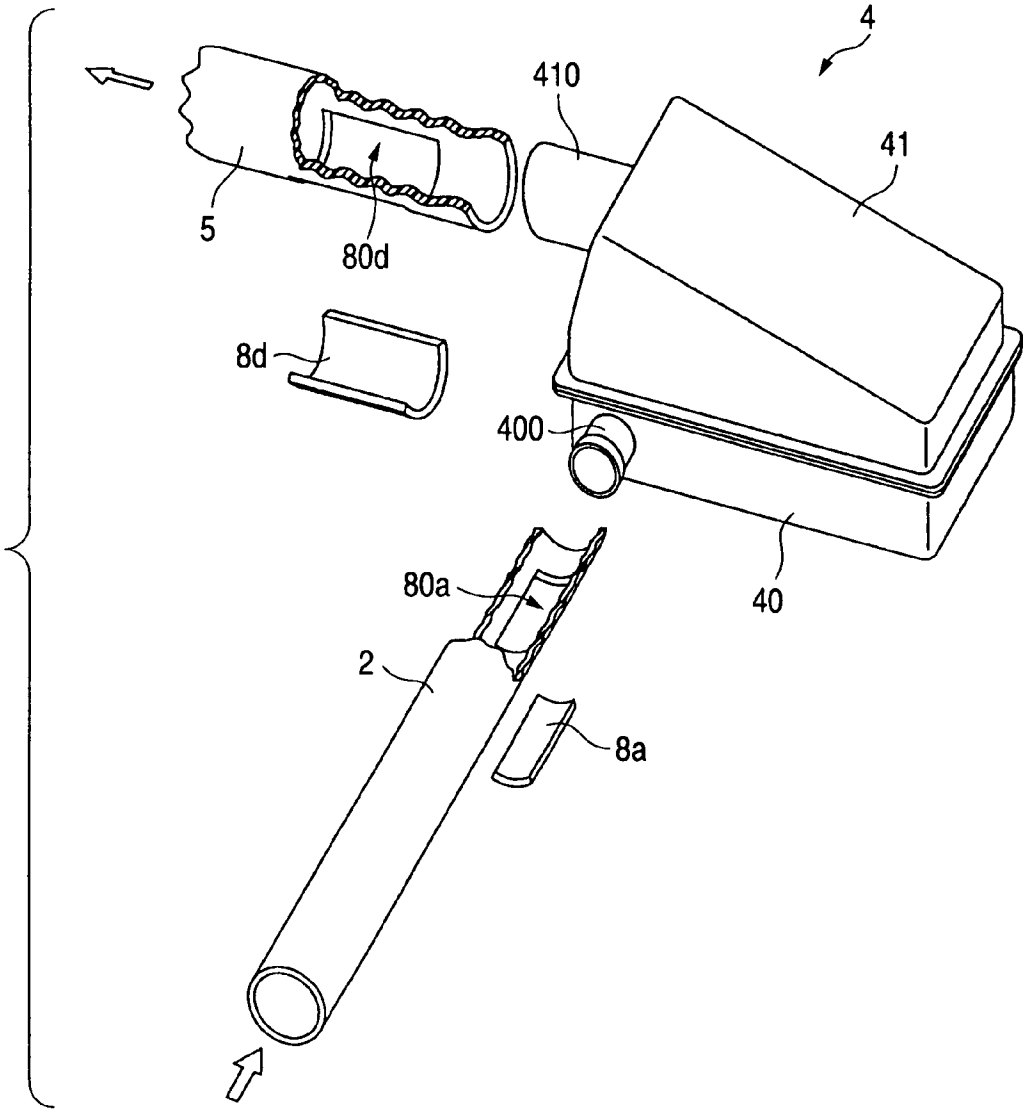
FIG. 4 is a fragmentary exploded view of the intake duct, the air cleaner, and an air cleaner hose of the intake apparatus in accordance with a third embodiment.

FIG. 4 shows a fragmentary exploded view of the intake duct, the air cleaner, and the air cleaner hose of the intake apparatus in accordance with this embodiment. It should be noted that portions corresponding to those of FIG. 2 will be denoted by the same reference numerals. As shown in the drawing, the transmission port 80*a* is formed in the side peripheral wall of the intake duct 2. The transmission port 80*a* is closed by the air-permeable member 8*a*. In addition, a transmission port 80*d* is formed in a side peripheral wall of the air cleaner hose 5. The transmission port 80*d* is closed by an air-permeable member 8*d*.

According to the intake apparatus 1 of this embodiment, the sound pressure of the intake sound and the sound pressure of the transmitted sound can be freely tuned over a wide frequency range. In addition, according to the intake apparatus 1 of this embodiment, the transmission port is not formed in the air cleaner 4. For this reason, a space for allowing the air transmitted through the air-permeable member to escape need not be secured on the outer side of the air cleaner 4. Accordingly, the intake apparatus 1 of this embodiment offers a high degree of freedom in the layout of the air cleaner 4.

(4) Fourth Embodiment

The difference between a fourth embodiment and the first embodiment lies in that the transmission ports are respectively disposed in the clean-side casing of the air cleaner and the air cleaner hose. Therefore, a description will be given herein of only the difference.

Figure 5:
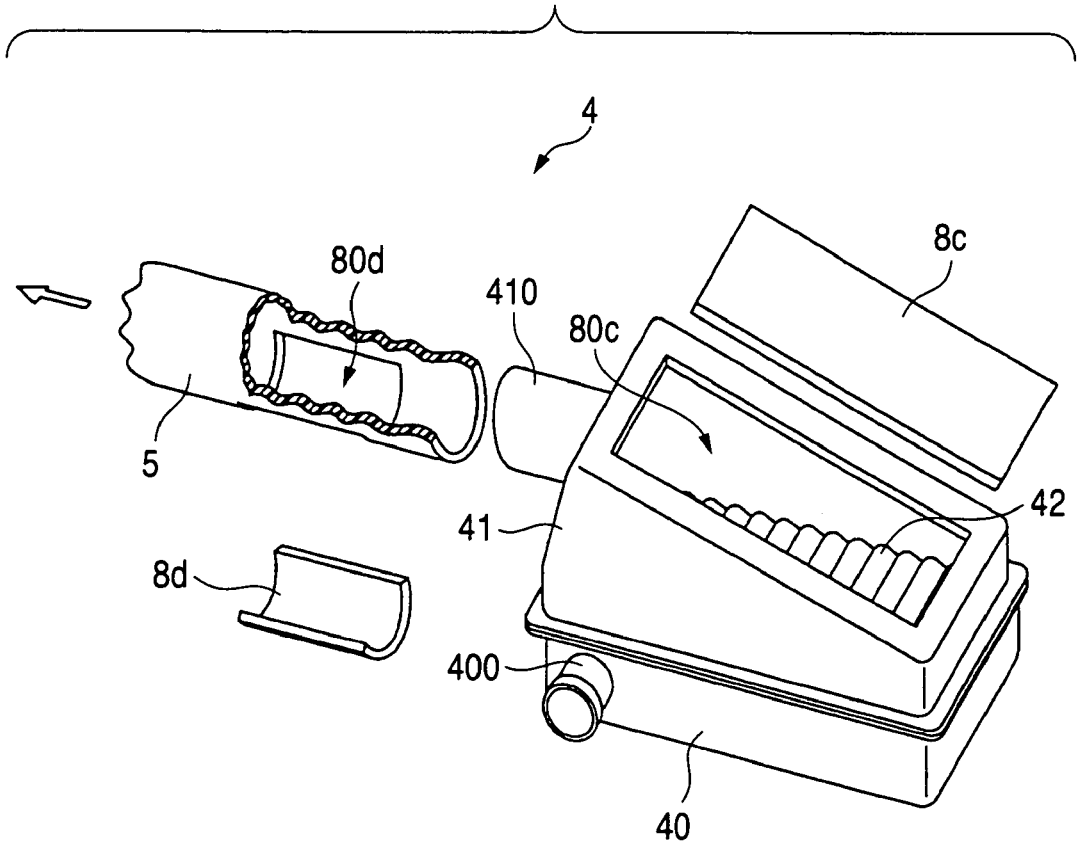
FIG. 5 is a fragmentary exploded view of the air cleaner and the air cleaner hose of the intake apparatus in accordance with a fourth embodiment.

FIG. 5 shows a fragmentary exploded view of the air cleaner and the air cleaner hose of the intake apparatus in accordance with this embodiment. It should be noted that portions corresponding to those of FIG. 2 will be denoted by the same reference numerals. As shown in the drawing, the transmission port 80*c* is formed in the clean-side casing 41 of the air cleaner 4. The transmission port 80*c* is closed by the air-permeable member 8*c*. In addition, the transmission port 80*d* is formed in the side peripheral wall of the air cleaner hose 5. The transmission port 80*d* is closed by the air-permeable member 8*d*.

According to the intake apparatus 1 of this embodiment, the sound pressure of the intake sound and the sound pressure of the transmitted sound can be freely tuned over a wide frequency range. In addition, according to the intake apparatus 1 of this embodiment, the transmission port 80*c* and the transmission port 80*d* are respectively disposed downstream of the element 42. Accordingly, the inner surface of the air-permeable member 8*c* and the inner surface of the air-permeable member 8*d* are constantly in contact with clean intake air. For this reason, the inner surface side of the transmission port 8*c* and the inner surface side of the transmission port 8*d* unlikely to be clogged.

(5) Fifth Embodiment

The difference between a fifth embodiment and the first embodiment lies in that the transmission ports are respectively disposed in the intake duct, the dirty-side casing of the air cleaner, and the air cleaner hose. Therefore, a description will be given herein of only the difference.

Figure 6:
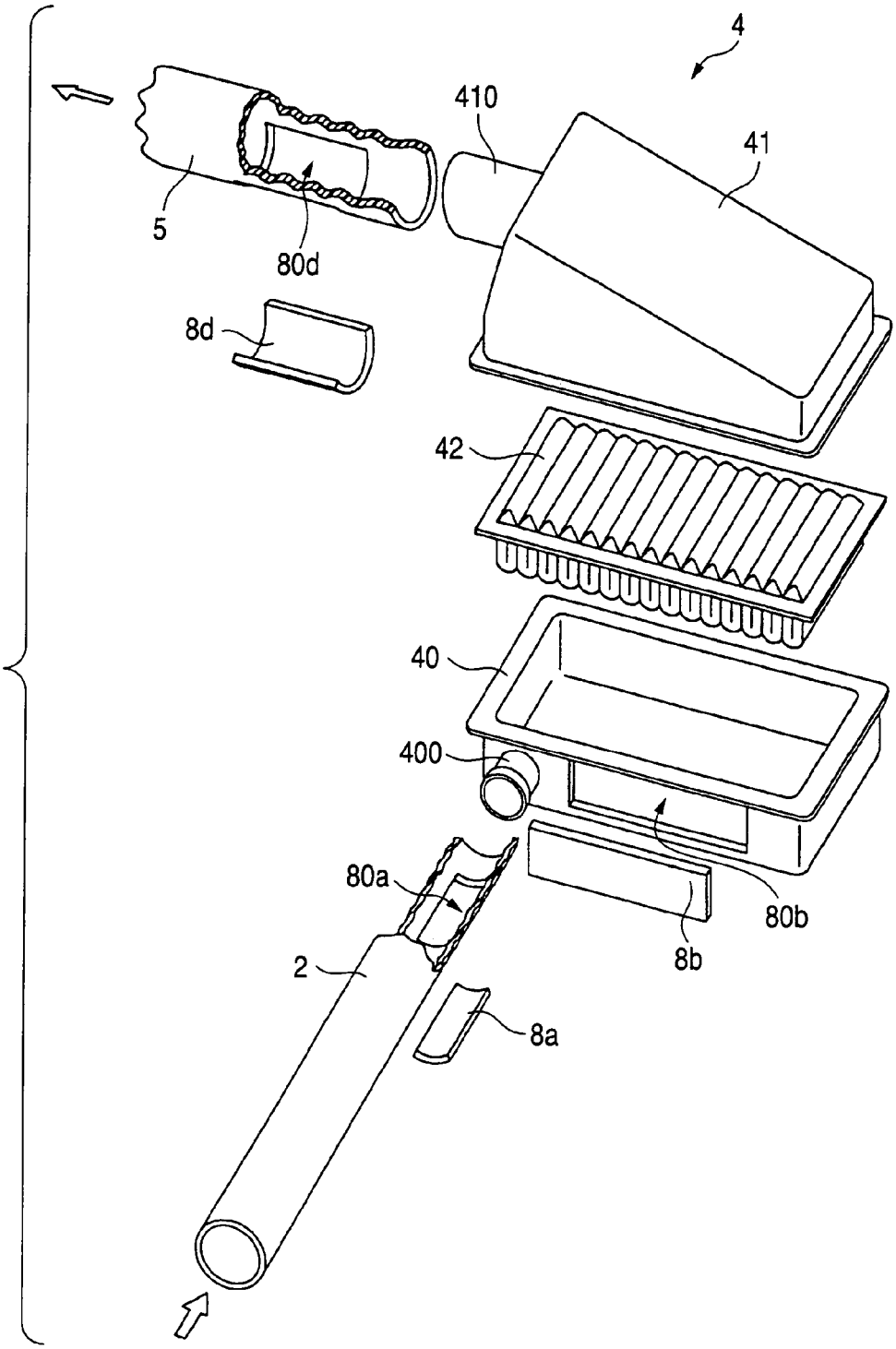
FIG. 6 is an exploded view of the intake duct, the air cleaner, and the air cleaner hose of the intake apparatus in accordance with a fifth embodiment.

FIG. 6 shows an exploded view of the intake duct, the air cleaner, and the air cleaner hose of the intake apparatus in accordance with this embodiment. It should be noted that portions corresponding to those of FIG. 2 will be denoted by the same reference numerals. As shown in the drawing, the transmission port 80*a* is formed in the side peripheral wall of the intake duct 2. The transmission port 80*a* is closed by the air-permeable member 8*a*. Further, the transmission port 80*b* is formed in the dirty-side casing 40 of the air cleaner 4. The transmission port 80*b* is closed by the air-permeable member 8*b*. Still further, the transmission port 80*d* is formed in the side peripheral wall of the air cleaner hose 5. The transmission port 80*d* is closed by the air-permeable member 8*d*.

According to the intake apparatus 1 of this embodiment, the transmission port and the air-permeable member are provided in three pairs. For this reason, the tuning of the intake sound and the transmitted sound is further facilitated.

(6) Sixth Embodiment

The difference between a sixth embodiment and the first embodiment lies in that the transmission ports are respectively disposed in the intake duct, the clean-side casing of the air cleaner, and the air cleaner hose. Therefore, a description will be given herein of only the difference.

Figure 7:
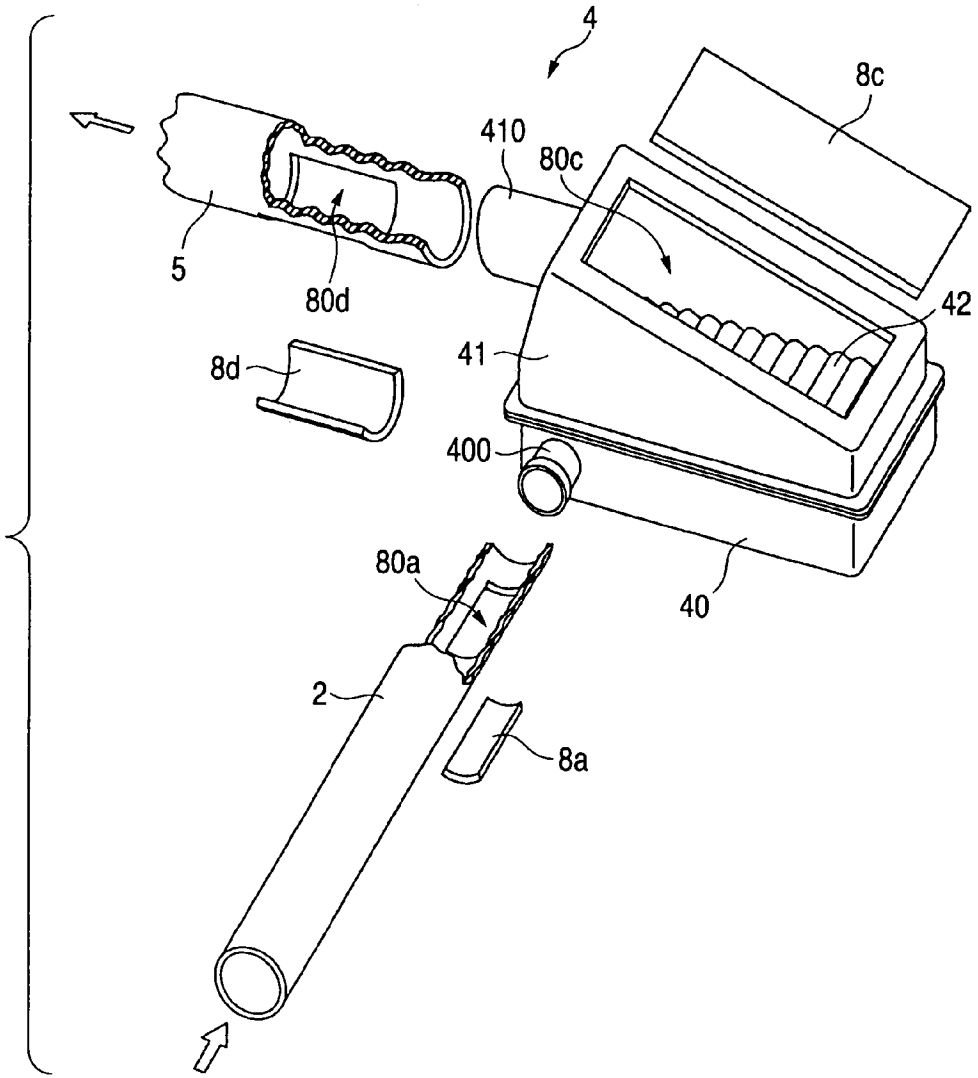
FIG. 7 is a fragmentary exploded view of the intake duct, the air cleaner, and the air cleaner hose of the intake apparatus in accordance with a sixth embodiment.

FIG. 7 shows a fragmentary exploded view of the intake duct, the air cleaner, and the air cleaner hose of the intake apparatus in accordance with this embodiment. It should be noted that portions corresponding to those of FIG. 2 will be denoted by the same reference numerals. As shown in the drawing, the transmission port 80*a* is formed in the side peripheral wall of the intake duct 2. The transmission port 80*a* is closed by the air-permeable member 8*a*. Further, the transmission port 80*c* is formed in the clean-side casing 41 of the air cleaner 4. The transmission port 80*c* is closed by the air-permeable member 8*c*. Still further, the transmission port 80*d* is formed in the side peripheral wall of the air cleaner hose 5. The transmission port 80*d* is closed by the air-permeable member 8*d*.

According to the intake apparatus 1 of this embodiment, the transmission port and the air-permeable member are provided in three pairs. For this reason, the tuning of the intake sound and the transmitted sound is further facilitated.

(7) Seventh Embodiment

Figure 9:
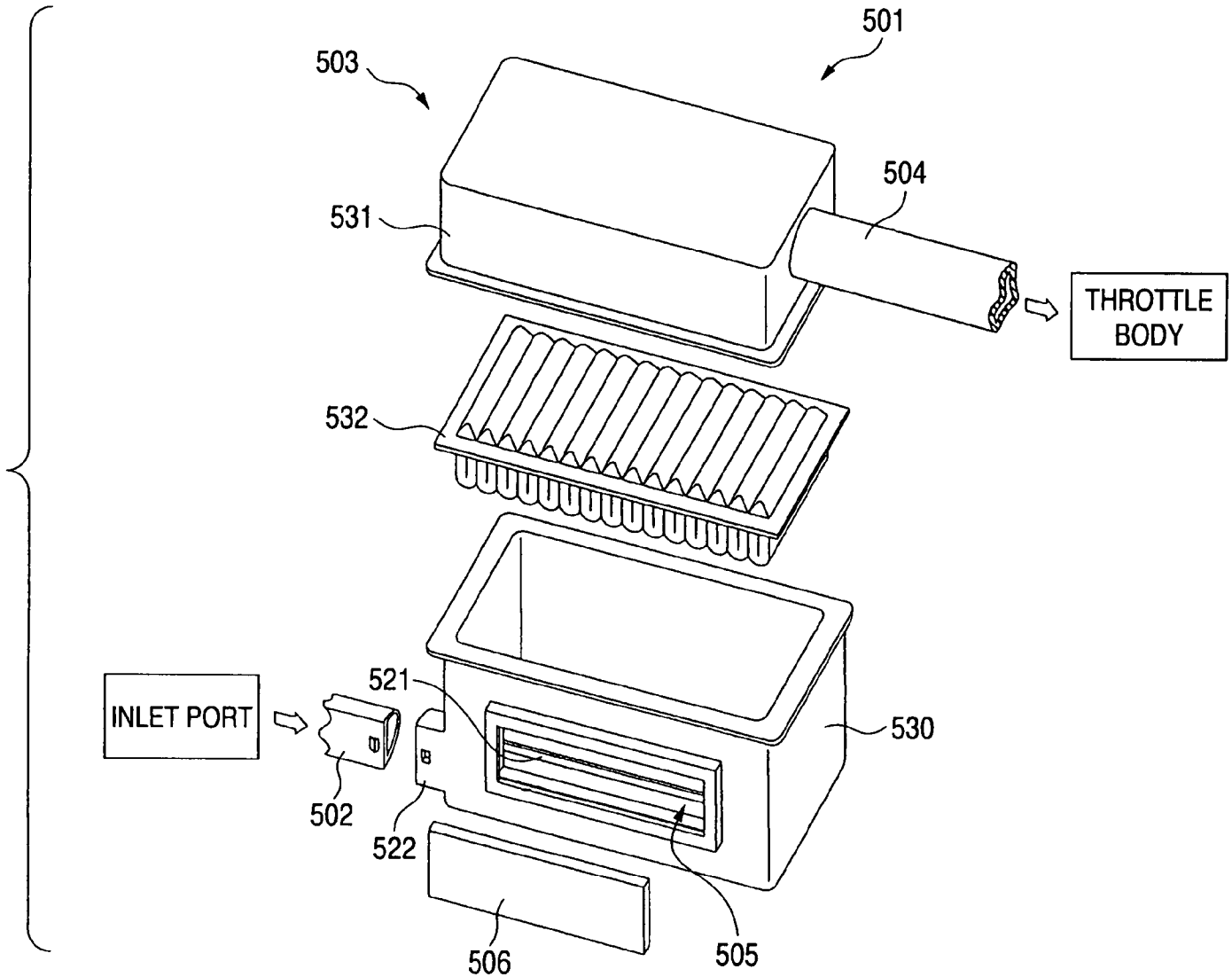
FIG. 9 is an exploded perspective view of an Intake apparatus in accordance with a seventh embodiment.

FIG. 9 shows an exploded perspective view of the intake apparatus in accordance with a seventh embodiment. As shown in the drawing, an intake apparatus 501 is comprised of an intake duct 502, an air cleaner 503, and an air cleaner hose 504.

The intake duct 502 is made of polypropylene (PP) and has a semicylindrical shape. The intake duct 502 communicates with the outside of the vehicle through an inlet port provided at an upstream end.

The air cleaner 503 has a dirty-side casing 530, a clean-side casing 531, and an element 532. The dirty-side casing 530 is made of PP with talc mixed in, and has the shape of an upwardly open box. A semicylindrical member 521 is accommodated in the dirty-side casing 530. A seal member (not shown) is disposed at a connecting end face on the upstream side of the semicylindrical member 521. On the upstream side of the semicylindrical member 521, this seal member separates the interior of the semicylindrical member 521 from the outside of the semicylindrical member 521, i.e., from the interior of the dirty-side casing 530. In addition, an intake-duct connecting tube 522 integrally projects from a side wall of the dirty-side casing 530. The intake-duct connecting tube 522 is connected to a downstream end of the intake duct 502 by the engagement of a pawl. Further, a rectangular transmission port is formed in a side wall of the dirty-side casing 530. The transmission port 505 is closed by a rectangular plate-shaped air-permeable member 506 which is formed of a polyethylene terephthalate (PET) nonwoven fabric. The construction of the air-permeable member 506 and its vicinities will be described later in detail.

The clean-side casing 531 is made of PP with talc mixed in, and has the shape of a downwardly open box. The clean-side casing 531 is disposed above the dirty-side casing 530 in a state in which its opening faces down.

The element 532 has the shape of a rectangular plate and is formed by tuck weaving a polyethylene terephthalate (PET) nonwoven fabric. The element 532 is clamped and fixed between opening edges of the dirty-side casing 530 and opening edges of the clean-side casing 531. Further, the element 532 partitions the closed space formed by the dirty-side casing 530 and the clean-side casing 531 into two upper and lower chambers.

The air cleaner hose 504 is made of chloroprene (CR) rubber and has a bellows tube shape. An upstream end of the air cleaner hose 504 is connected to a hose connecting tube (not shown) projecting from an outer surface of a side wall of the clean-side casing 531. A throttle body is connected to a downstream end of the air cleaner hose 504. In addition, an intake manifold (not shown), which is branch-connected to combustion chambers (not shown), is connected to a downstream end of the throttle body. The intake air sucked into the inlet port from the outside passes the interior of the intake apparatus 501 in the order of the intake duct 502, the semicylindrical member 521, the dirty-side casing 530, the element 532, the clean-side casing 531, the air cleaner hose 504, the throttle body, and the intake manifold, and flows into the combustion chambers.

Figure 10:
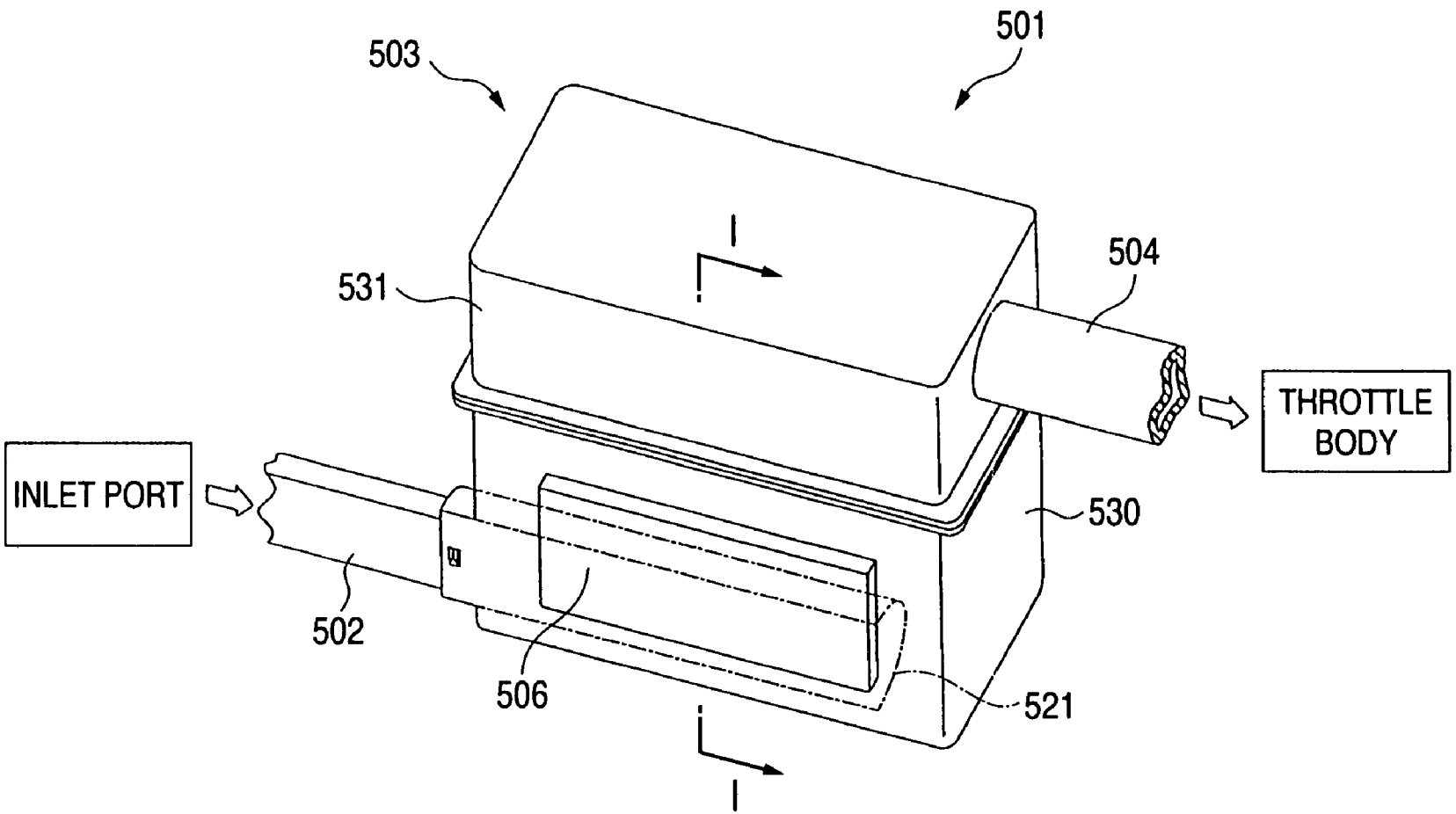
FIG. 10 is a perspective view of the intake apparatus in accordance with the seventh embodiment.
Figure 11:
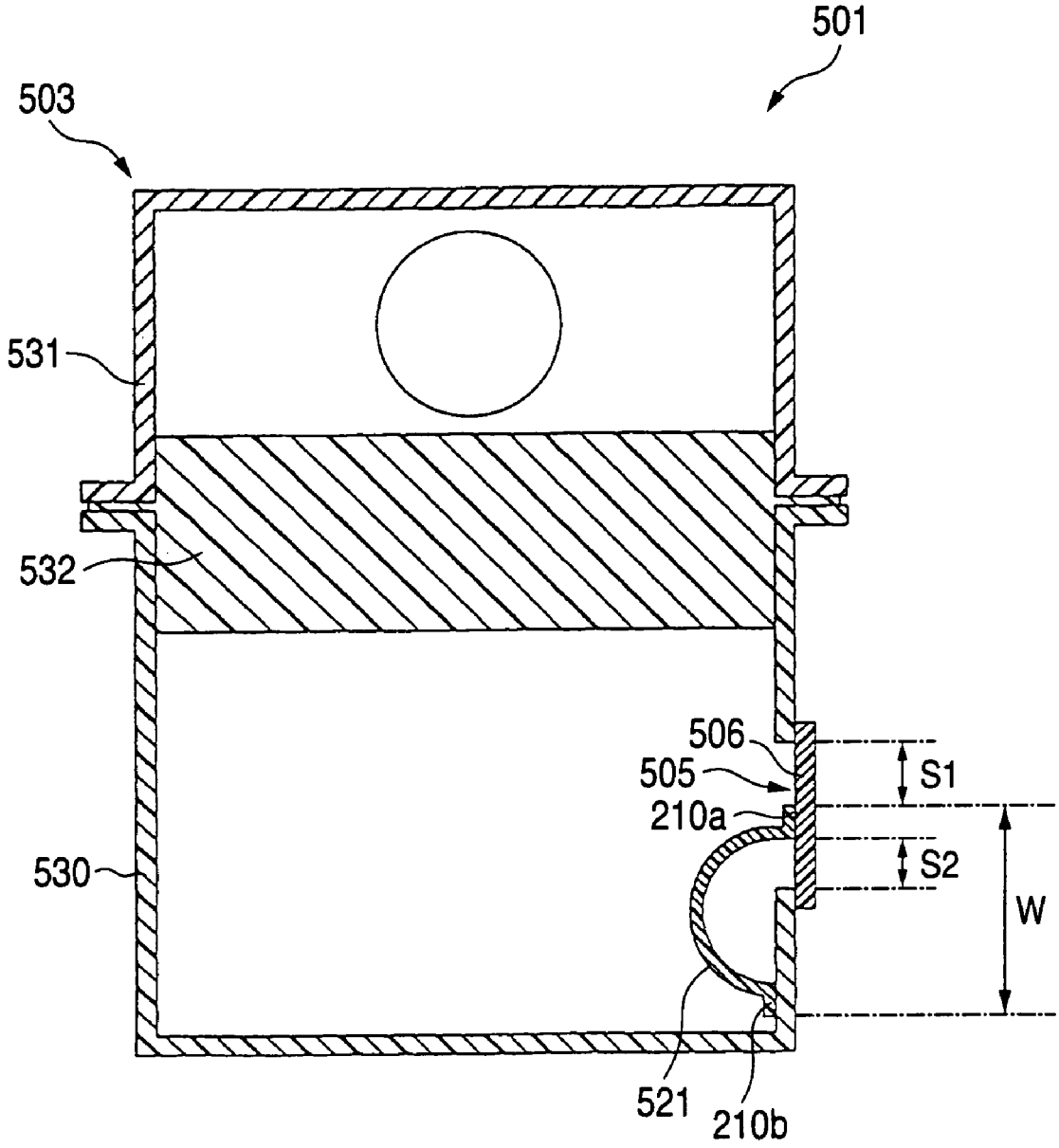
FIG. 11 is a cross-sectional view taken along line I—I of FIG. 10.

Next, the construction of the air-permeable member and its vicinities will be described in detail. FIG. 10 shows a perspective view of the intake apparatus in accordance with this embodiment. As shown by chain lines in FIG. 10, the semicylindrical member 521 extends in the dirty-side casing 530 with a predetermined space left at the right-hand end in the drawing. FIG. 11 shows a cross-sectional view taken along line I—I of FIG. 10. As shown in FIG. 11, of an outer wall of the dirty-side casing 530, a portion which also serves as an outer wall of the semicylindrical member 521 is a dual-use outer wall portion W. Of the outer walls of the dirty-side casing 530 and the outer walls of the clean-side casing 531, portions other than the dual-use outer wall portion W are exclusive-use outer wall portions. The transmission port 505 is formed in such a manner as to extend over the dual-use outer wall portion W and the exclusive-use outer wall portion. The air-permeable member 506 is welded to opening edges of the transmission port 505 from the outer side of the dirty-side casing 530. The semicylindrical member 521 has a C-shaped cross section. Fixing seats 210*a* and 210*b* are formed at circumferentially opposite ends, of the semicylindrical member 521, i.e., at both ends of the C-shape. The fixing seat 210*a* is welded to an inner surface of the air-permeable member 506. The fixing seat 210*b* is welded to an inner surface of the side wall of the dirty-side casing 530. Of the air-permeable member 506, a portion S1 higher than the fixing seat 210*a* functions as an air-permeable member exclusively used for the dirty-side casing 530, i.e., the air cleaner 503. Meanwhile, of the air-permeable member 506, a portion S2 lower than the fixing seat 210*a* functions as an air-permeable member exclusively used for the semicylindrical member 521, i.e., the intake duct 502.

Next, a description will be given of the effects of the intake apparatus of this embodiment. According to the intake apparatus 501 of this embodiment, the semicylindrical member 521 has the function of a downstream end portion of the intake duct in the conventional intake apparatus. For this reason, the duct length of the intake duct 502 can be shorter by the portion of the length of the semicylindrical member 521. Accordingly, the intake apparatus of this embodiment excels in the space saving characteristic.

In addition, according to the intake apparatus 501 of this embodiment, the air-permeable member 506 is disposed at a position where antinodes of standing waves of the intake sound are present. For this reason, the intake sound can be suppressed over a wide frequency range.

In addition, the transmission port 505 is formed in such a manner as to extend over the dual-use outer wall portion W and the exclusive-use outer wall portion. Accordingly, the transmission port 505 of the intake apparatus 501 of this embodiment has both a portion which functions to be used for the semicylindrical member 521, i.e., the intake duct 502, and a portion which functions to be used for the air cleaner 503. For this reason, the air-permeable member 506 also has both the portion which functions to be used for the semicylindrical member 521, i.e., the intake duct 502, and the portion which functions to be used for the air cleaner 503. Therefore, according to the intake apparatus 501 of this embodiment, it is unnecessary to dispose air-permeable members by forming transmission ports in the respective members of the air cleaner 503, the intake duct 502, and the air cleaner hose 504. For this reason, the number of assembling steps is small, and the number of component parts is also small.

In addition, according to the intake apparatus 501 of this embodiment, the transmission port 505 and the air-permeable member 506 are disposed in the dirty-side casing 530. Accordingly, even if dust enters the dirty-side casing 530 through the air-permeable member 506, the element 532 is capable of filtering the dust.

Incidentally, to suppress the intake sound more effectively, it suffices if the amount of air permeation of the air-permeable member 506 is tuned. Specifically, it suffices if the area of the air-permeable member for the air cleaner 503 and the area of the air-permeable member for the intake duct 502 are adjusted.

In this respect, according to the intake apparatus 1 of this embodiment, it is possible to effect tuning by merely raising or lowering the place of disposition of the transmission port 505 and the air-permeable member 506. Namely, by raising the place of disposition of the transmission port 505 and the air-permeable member 506, it is possible to widen the width (area) of the portion S1 higher than the fixing seat 210*a*. Meanwhile, it is possible to narrow the width (area) of the portion S2 lower than the fixing seat 210*a*. On the other hand, by lowering the place of disposition of the transmission port 505 and the air-permeable member 506, it is possible to narrow the width (area) of the portion S1 higher than the fixing seat 210*a*. Meanwhile, it is possible to widen the width (area) of the portion S2 lower than the fixing seat 210*a*. Thus, according to the intake apparatus 501 of this embodiment, the amount of air permeation can be tuned relatively easily.

(8) Eighth Embodiment

The difference between an eighth embodiment and the seventh embodiment lies in that the transmission port and the air-permeable member are disposed in a bottom wall of the dirty-side casing. Therefore, a description will be given herein of only the difference.

Figure 12:
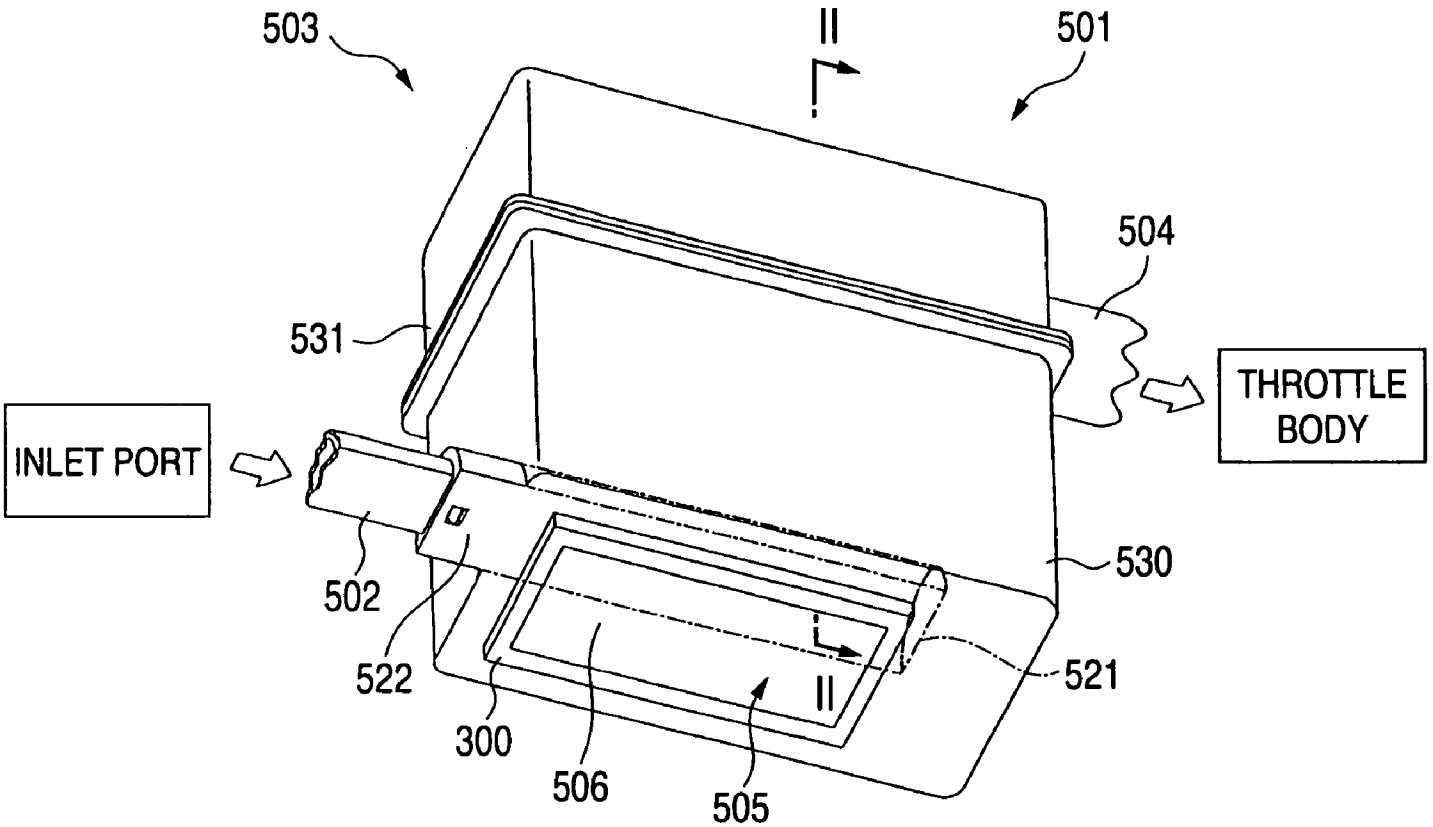
FIG. 12 is a perspective view of the intake apparatus in accordance with a eighth embodiment.
Figure 13:
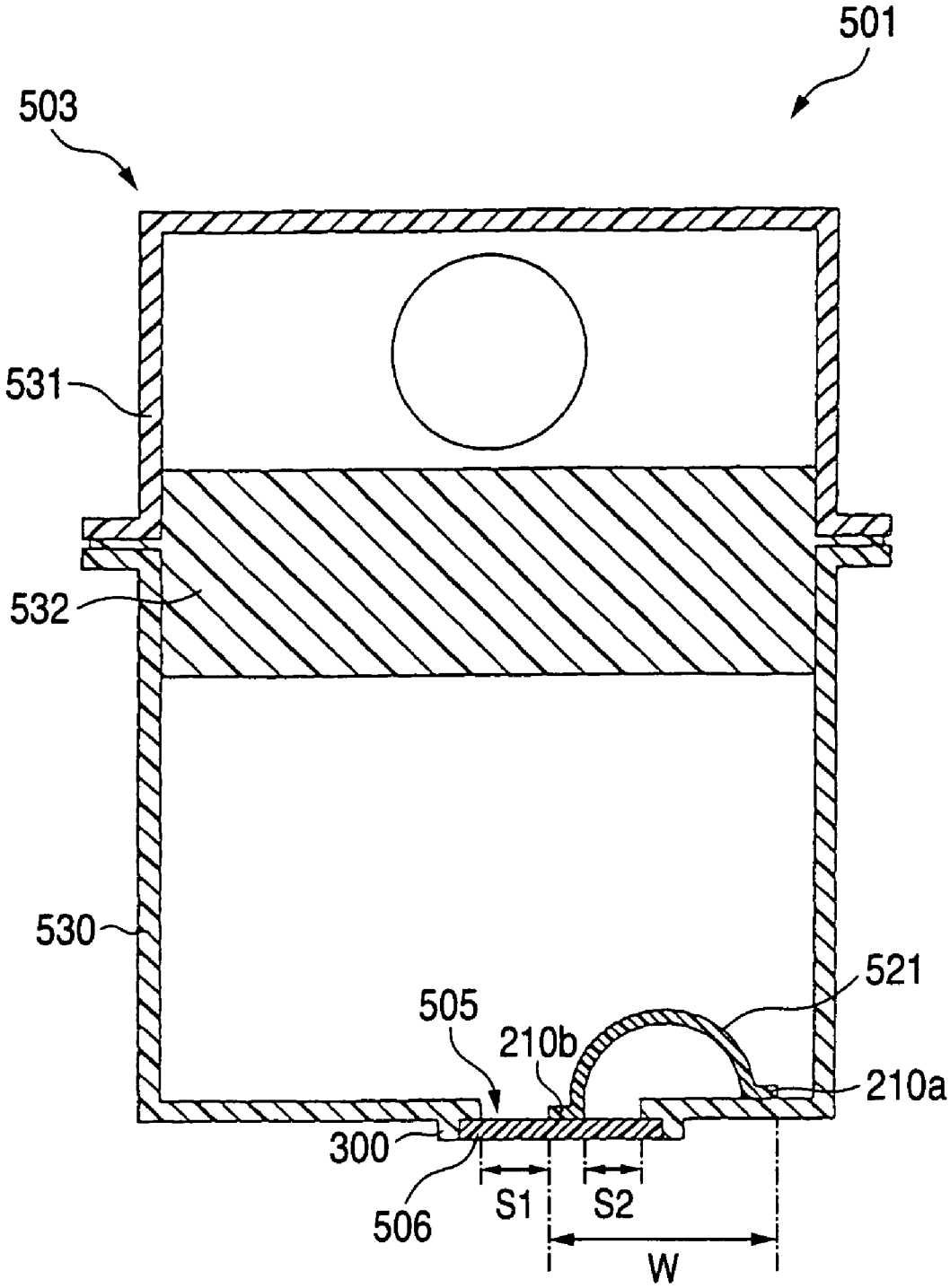
FIG. 13 is a cross-sectional view taken along line II—II of FIG. 12.

FIG. 12 shows a perspective view of the intake apparatus in accordance with this embodiment. It should be noted that portions corresponding to those of FIG. 10 will be denoted by the same reference numerals. As shown in the drawing, the transmission port 505 is formed in the bottom wall of the dirty-side casing 530. Further, the air-permeable member 506 is disposed so as to close the transmission port 505. FIG. 13 shows a cross-sectional view taken along line II—II of FIG. 504. It should be noted that portions corresponding to those of FIG. 11 will be denoted by the same reference numerals. As shown in FIG. 13, of an outer wall of the dirty-side casing 530, a portion which also serves as an outer wall of the semicylindrical member 521 is the dual-use outer wall portion W. Of the outer walls of the dirty-side casing 530 and the outer walls of the clean-side casing 531, portions other than the dual-use outer wall portion W are the exclusive-use outer wall portions. The transmission port 505 is formed in such a manner as to extend over the dual-use outer wall portion W and the exclusive-use outer wall portion. The air-permeable member 506 is molded integrally by injection molding at inner portions of a frame member 300 surrounding opening edges of the transmission port 505. Of the air-permeable member 506, the portion S1 located leftwardly of the fixing seat 210*b* in the drawing functions as an air-permeable member exclusively used for the dirty-side casing 530, i.e., the air cleaner 503. Meanwhile, of the air-permeable member 506, the portion S2 located rightwardly of the fixing seat 210*b* in the drawing functions as an air-permeable member exclusively used for the semicylindrical member 521, i.e., the intake duct 502.

Next, a description will be given of effects of the intake apparatus of this embodiment which are different from those of the seventh embodiment. According to the intake apparatus 501 of this embodiment, the transmission port 505 and the air-permeable member 506 are disposed in the bottom wall of the dirty-side casing 530. For this reason, the transmission port 505 and the air-permeable member 506 are not conspicuous in the engine compartment. Accordingly, the intake apparatus of this embodiment excels in the design feature. In addition, in a case where the air cleaner 503 is mounted on an upper surface of an engine cover (not shown), the sound which is transmitted through the air-permeable member, i.e., the transmitted sound, collides against the engine cover. For this reason, it is possible to suppress not only the intake sound but also the transmitted sound.

(9) Ninth Embodiment

A difference between a ninth embodiment and the seventh embodiment lies in that the transmission port and the air-permeable member are disposed in the bottom wall of the dirty-side casing. Another difference lies in that not only the intake duct but the air cleaner hose communicates with the semicylindrical member inside the air cleaner. Therefore, a description will be given herein of only the differences.

Figure 14:
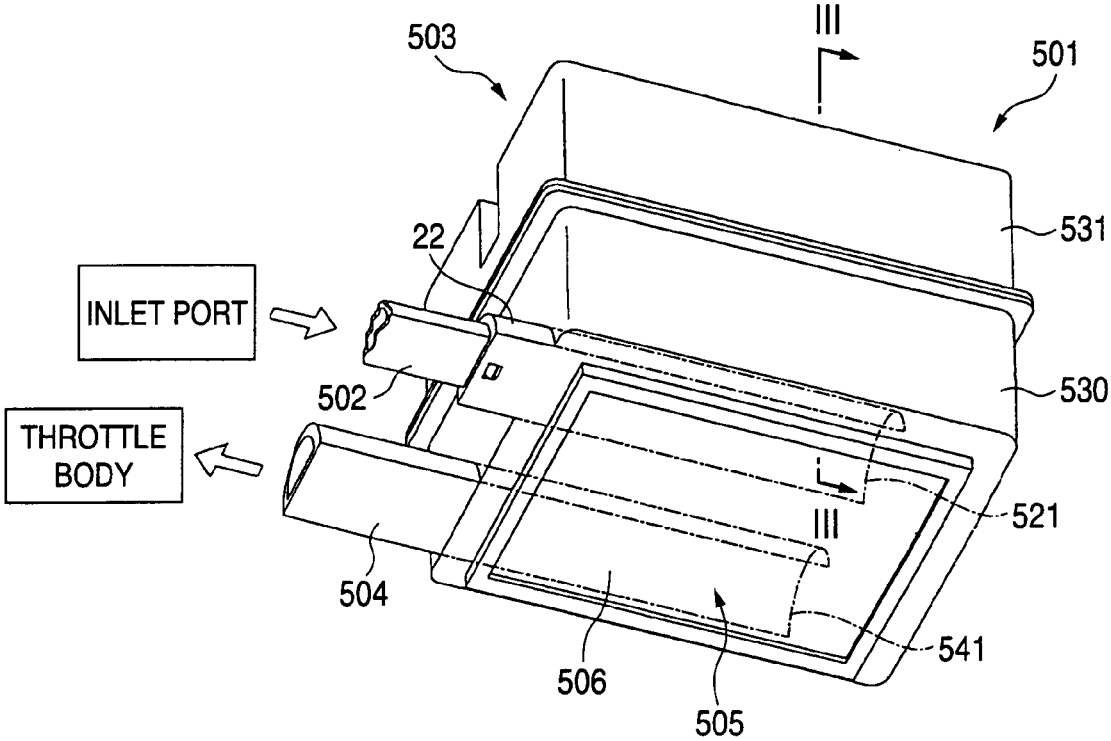
FIG. 14 is a perspective view of the intake apparatus in accordance with a ninth embodiment.

FIG. 14 shows a perspective view of the intake apparatus in accordance with this embodiment. It should be noted that portions corresponding to those of FIG. 10 will be denoted by the same reference numerals. As shown in the drawing, the transmission port 5 is formed in the bottom wall of the dirty-side casing 530. Further, the air-permeable member 506 is disposed so as to close the transmission port 505. In addition, apart from the semicylindrical member 521 for the intake duct 502, a semicylindrical member 541 for the air cleaner hose 504 is accommodated in the dirty-side casing 530. In the same way as the semicylindrical member 521, the semicylindrical member 541 extends in the dirty-side casing 530 with a predetermined space left at the right-hand end in the drawing. Thus, in this embodiment, two semicylindrical members are disposed.

Figure 15:
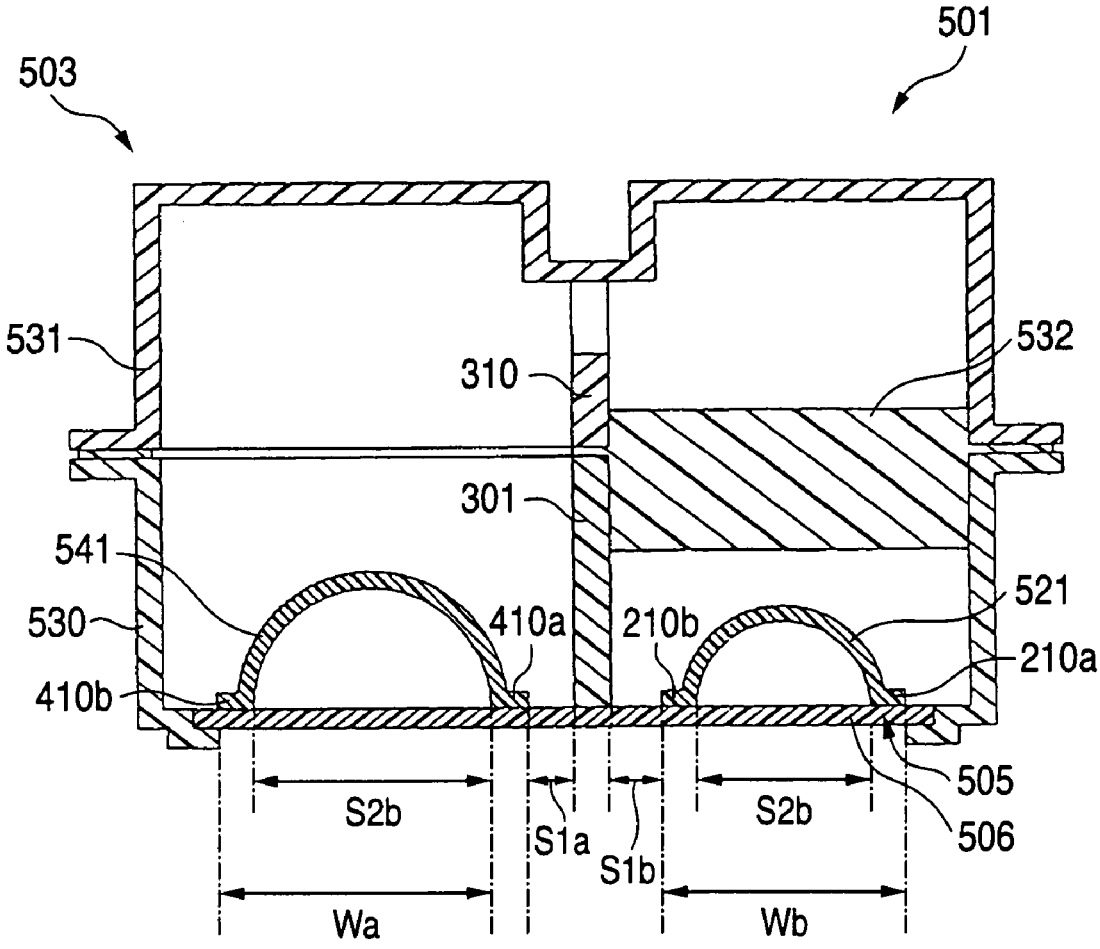
FIG. 15 is a cross-sectional view taken along line III—III of FIG. 14.

FIG. 15 shows a cross-sectional view taken along line III—III of FIG. 14. It should be noted that portions corresponding to those of FIG. 11 will be denoted by the same reference numerals. As shown in the drawing, the semicylindrical member 541 has a C-shaped cross section. Fixing seats 410*a* and 410*b* are formed at circumferentially opposite ends of the semicylindrical member 541, i.e., at both ends of the C-shape. The fixing seats 410*a* and 410*b* are welded to the inner surface of the air-permeable member 506. A plate-like dirty-side holder 301 projects from the inner surface of the bottom wall of the dirty-side casing 530. Meanwhile, a frame-shaped clean-side holder 310 projects from an inner surface of an upper bottom wall of the clean-side casing 531 in such a manner as to oppose the dirty-side holder 301. One side of the element 532 is clamped and fixed by the dirty-side holder 301 and the clean-side holder 310.

Of an outer wall of the dirty-side casing 530, a portion which also serves as an outer wall of the semicylindrical member 521 is a dual-use outer wall portion Wb. Further, a portion which also serves as an outer wall of the semicylindrical member 541 is a dual-use outer wall portion Wa. In addition, of the outer walls of the dirty-side casing 530 and the outer walls of the clean-side casing 531, portions other than the dual-use outer wall portions Wa and Wb are exclusive-use outer wall portions. The transmission port 505 is formed in such a manner as to extend over the dual-use outer wall portions Wa and Wb and the exclusive-use outer wall portion. Of the air-permeable member 506 closing the transmission port 505, a portion S2*a* defined by the fixing seat 210*a* and the fixing seat 210*b* functions as an air-permeable member exclusively used for the semicylindrical member 521, i.e., the intake duct 502. In addition, of the air-permeable member 506 closing the transmission port 505, a portion S2*b* defined by the fixing seat 410*a* and the fixing seat 410*b* functions as an air-permeable member exclusively used for the semicylindrical member 541, i.e., the air cleaner hose 504. Furthermore, of the air-permeable member 506 closing the transmission port 505, a portion S1*b* defined by the fixing seat 210*b* and the dirty-side holder 301 and a portion S1*a* defined by the dirty-side holder 301 and the fixing seat 410*a* function as air-permeable members exclusively used for the dirty-side casing 530, i.e., the air cleaner 503.

Next, a description will be given of effects of the intake apparatus in accordance with this embodiment which are different from those of the seventh and eighth embodiments. According to the intake apparatus 1 of this embodiment, the transmission port 505 and the air-permeable member 506 are used in common to the semicylindrical member 521, the air cleaner 503, and the semicylindrical member 541. Namely, the transmission port 505 and the air-permeable member 506 are used in common to the intake duct 502, the air cleaner 503, and the air cleaner hose 504. For this reason, the number of assembling steps is further reduced. Additionally, the number of component parts is also further reduced. Moreover, it is possible to suppress the intake sound over a wider frequency range.

According to the intake apparatus 501 of this embodiment, the semicylindrical member 541 has the function of an upstream end portion of the air cleaner hose in the conventional intake apparatus. For this reason, the hose length of the air cleaner hose 504 can be shorter by the portion of the length of the semicylindrical member 541. Accordingly, the intake apparatus of this embodiment excels further in the space saving characteristic.

(10) Tenth Embodiment

Figure 16:
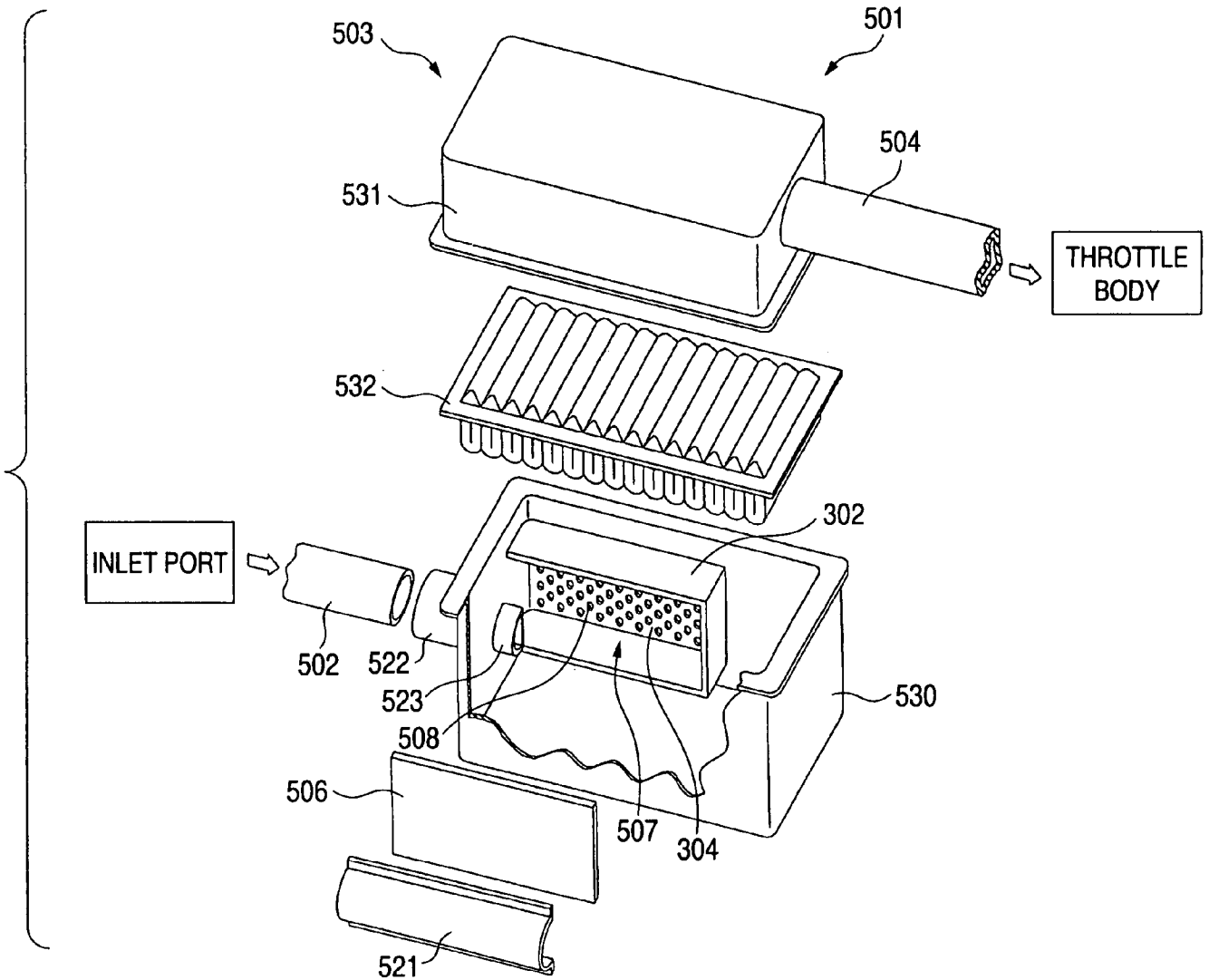
FIG. 16 is an exploded perspective view of the intake apparatus in accordance with a tenth embodiment.
Figure 17:
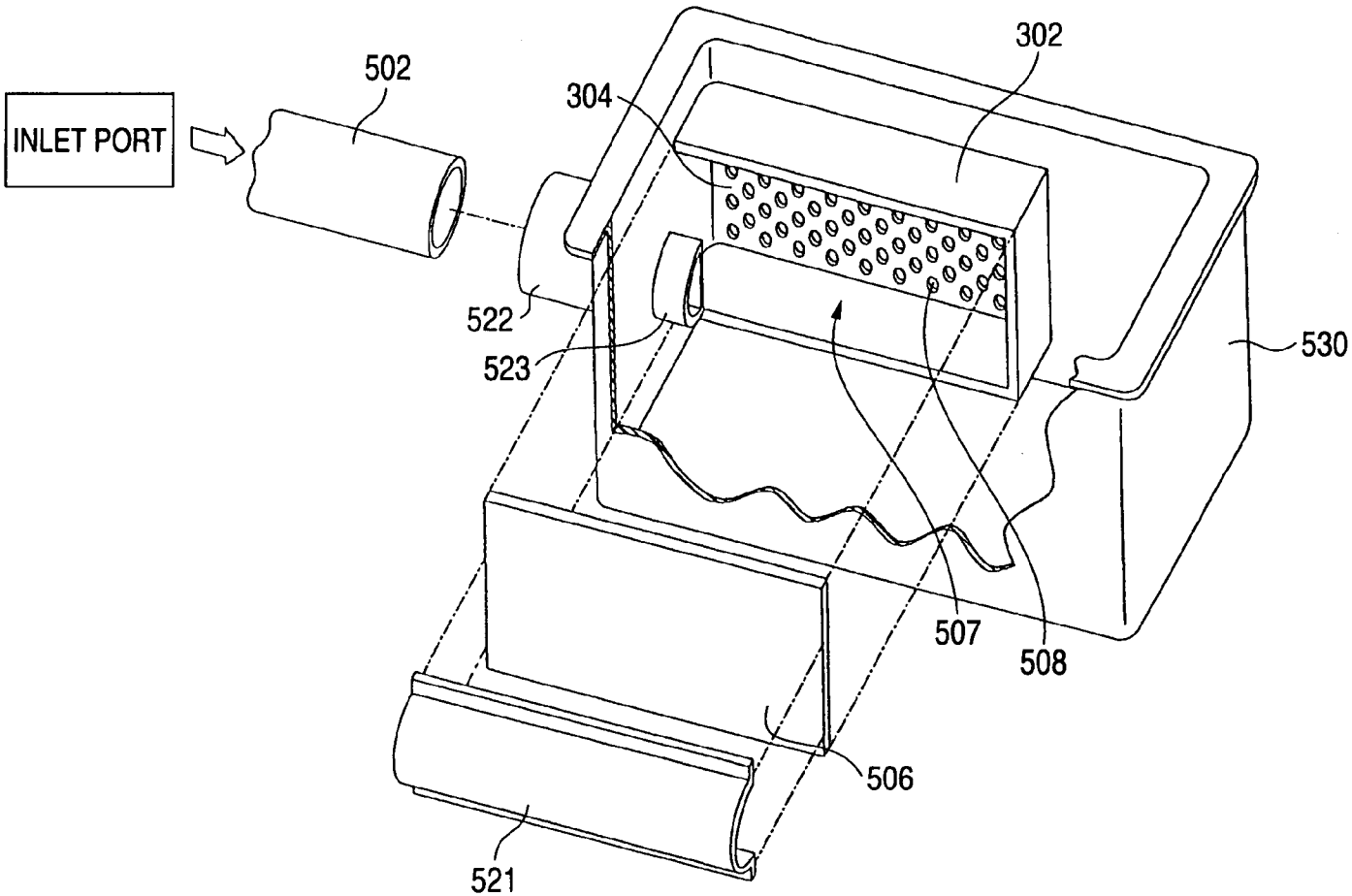
FIG. 17 is an exploded perspective view of a dirty-side casing of the intake apparatus in accordance with the tenth embodiment.
Figure 18:
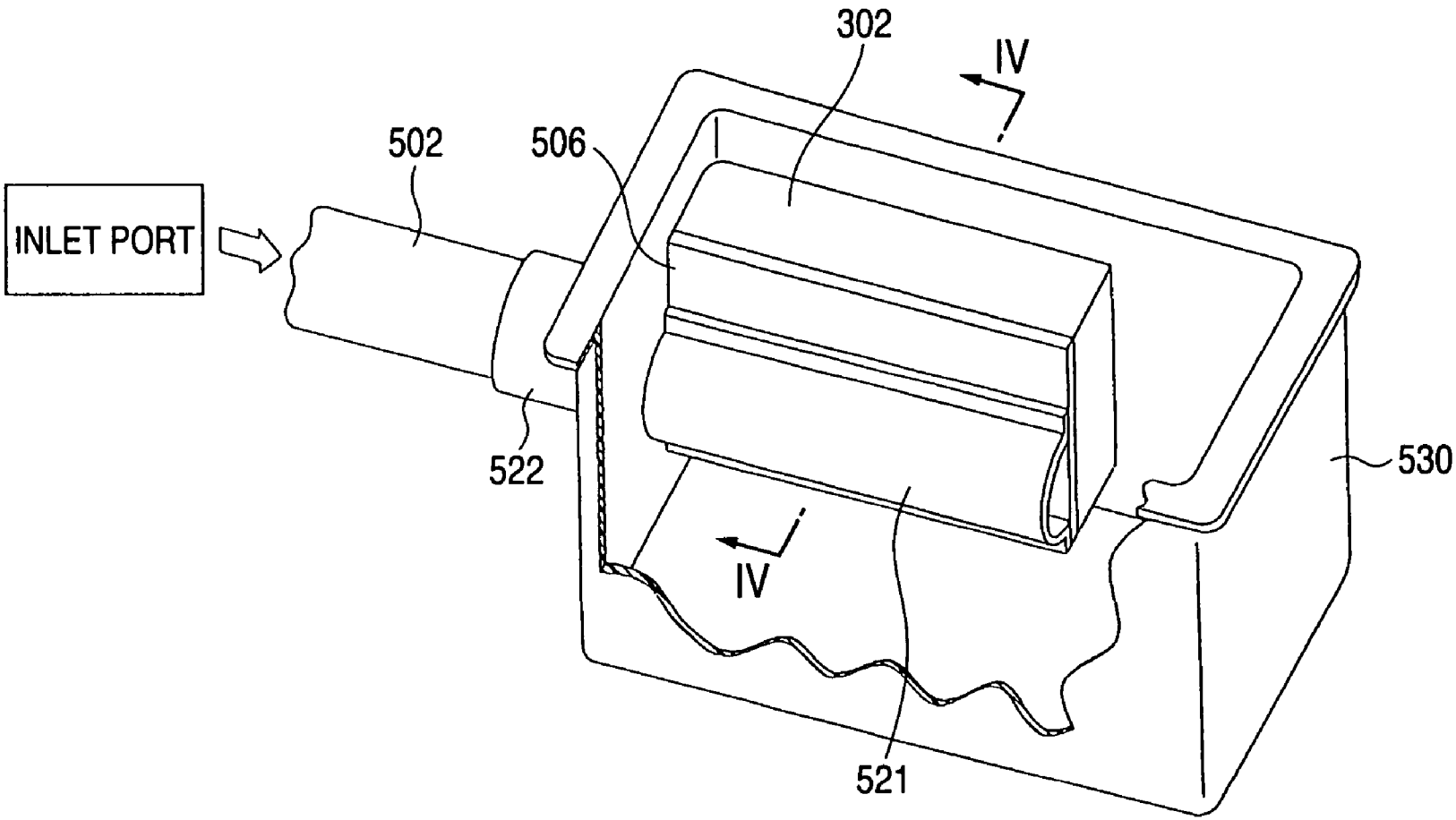
FIG. 18 is a perspective view of the dirty-side casing of the intake apparatus in accordance with the tenth embodiment.

A description will be given of the construction of the intake apparatus in accordance with a tenth embodiment. FIG. 16 shows an exploded perspective view of the intake apparatus in accordance with this embodiment. Further, FIG. 17 shows an exploded perspective view of the dirty-side casing of the intake apparatus in accordance with this embodiment. FIG. 18 shows a perspective view of the dirty-side casing of the intake apparatus in accordance with this embodiment. It should be noted that in these drawings portions corresponding to those of FIG. 9 will be denoted by the same reference numerals. As shown in the drawings, the intake apparatus 501 is comprised of the intake duct 502, the air cleaner 503, and the air cleaner hose 504.

The intake duct 502 is made of PP and has a semicylindrical shape. The intake duct 502 communicates with the outside of the vehicle through the inlet port provided at an upstream end.

The air cleaner 503 has the dirty-side casing 530, the clean-side casing 531, and the element 532. The dirty-side casing 530 is made of PP with talc mixed in, and has the shape of an upwardly open box. A multiplicity of communicating holes 508 are interspersed in a sound-shielding wall portion 304 of a side wall of the dirty-side casing 530. The communicating holes 8 are included among communicating ports of the invention. Sound shielding ribs 302 project in a U-shape from edges of the sound-shielding wall portion 304 in the inner surface of the side wall of the dirty-side casing 530. The rectangular plate-shaped air-permeable member 506 made of a PET nonwoven fabric is welded to distal end faces of the sound shielding ribs 302. A sound shielding chamber 507 is compartmentalized by the rear surface of the air-permeable member 506, the sound shielding ribs 302, and the sound-shielding wall portion 304. The semicylindrical member 521 is welded to the surface of the air-permeable member 506. The semicylindrical member 521 is included among half-split members of the invention. As for the construction of the air-permeable member 506 and its vicinities, a detailed description will be given later. A semicylindrical-member connecting tube 523 is inserted in one axial end of the semicylindrical member 521. The other axial end of the semicylindrical member 521 is open in the dirty-side casing 530. The intake-duct connecting tube 522 integrally projects from the outer surface of the side wall of the dirty-side casing 530. The intake-duct connecting tube 522 communicates with the semicylindrical-member connecting tube 523. Further, the intake-duct connecting tube 522 is fitted to a downstream end of the intake duct 502.

The clean-side casing 531 is made of PP with talc mixed in, and has the shape of a downwardly open box. The clean-side casing 531 is disposed above the dirty-side casing 530 in a state in which its opening faces down.

The element 532 has the shape of a rectangular plate and is formed by tuck weaving a polyethylene terephthalate (PET) nonwoven fabric. The element 532 is clamped and fixed between opening edges of the dirty-side casing 530 and opening edges of the clean-side casing 531. Further, the element 532 partitions the closed space formed by the dirty-side casing 530 and the clean-side casing 531 into two upper and lower chambers.

The air cleaner hose 504 is made of CR and has a bellows tube shape. An upstream end of the air cleaner hose 504 is connected to a hose connecting tube (not shown) projecting from an outer surface of a side wall of the clean-side casing 531. A throttle body is connected to a downstream end of the air cleaner hose 504. In addition, an intake manifold (not shown), which is branch-connected to combustion chambers (not shown), is connected to a downstream end of the throttle body. The intake air sucked into the inlet port from the out side passes the interior of the intake apparatus 501 in the order of the intake duct 502, the semicylindrical member 521, the dirty-side casing 530, the element 532, the clean-side casing 531, the air cleaner hose 504, the throttle body, and the intake manifold, and flows into the combustion chambers.

Figure 19:
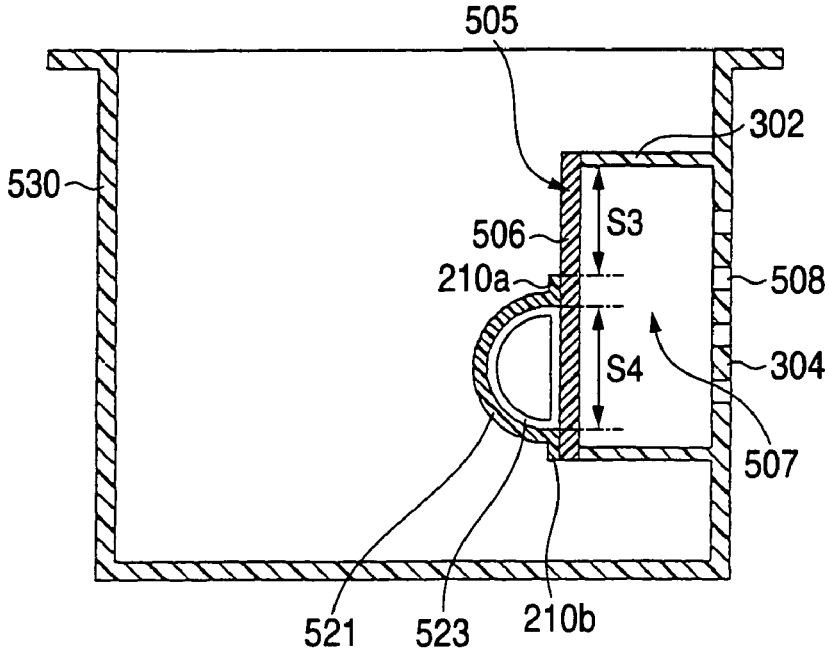
FIG. 19 is a cross-sectional view taken along line IV—IV of FIG. 18.

Next, the construction of the air-permeable member and its vicinities will be described in detail. FIG. 19 shows a cross-sectional view taken along line IV—IV of FIG. 18. It should be noted that portions corresponding to those of FIG. 11 will be denoted by the same reference numerals. As shown in the drawings, the semicylindrical member 521 has a C-shaped cross section. The fixing seats 210*a* and 210*b* are formed at circumferentially opposite ends of the semicylindrical member 521, i.e., at both ends of the C-shape. Both fixing seats 210*a* and 210*b* are welded to the surface of the air-permeable member 506. Of the air-permeable member 506, a portion S3 higher than the fixing seat 210*a* functions as an air-permeable member exclusively used for the dirty-side casing 530, i.e., the air cleaner 503. Meanwhile, of the air-permeable member 506, a portion S4 lower than the fixing seat 210*a* functions as an air-permeable member exclusively used for the semicylindrical member 521, i.e., the intake duct 502.

Next, a description will be given of the effects of the intake apparatus of this embodiment. According to the intake apparatus 501 of this embodiment, the semicylindrical member 521 has the function of a downstream end portion of the intake duct in the conventional intake apparatus. For this reason, the duct length of the intake duct 502 can be shorter by the portion of the length of the semicylindrical member 521. Accordingly, the intake apparatus of this embodiment excels in the space saving characteristic.

In addition, according to the intake apparatus 501 of this embodiment, the air-permeable member 506 is disposed at a position where antinodes of standing waves of the intake sound are present. For this reason, the intake sound can be suppressed over a wide frequency range.

In addition, the air-permeable member 506 of the intake apparatus 501 of this embodiment has both a portion which functions to be used for the semicylindrical member 521, i.e., the intake duct 502, and a portion which functions to be used for the air cleaner 503. Therefore, according to the intake apparatus 501 of this embodiment, it is unnecessary to dispose air-permeable members in the respective members of the air cleaner 503, the intake duct 502, and the air cleaner hose 504. For this reason, the number of assembling steps is small, and the number of component parts is also small.

In addition, according to the intake apparatus 501 of this embodiment, the communicating holes 508 are provided in the sound-shielding wall portion 304 of the dirty-side casing 530. Accordingly, even if dust enters the dirty-side casing 530 through the communicating holes 508, the element 532 is capable of filtering the dust.

In addition, the sound shielding chamber 507 is compartmentalized between the sound-shielding wall portion 304 and the air-permeable member 506. The sound which is transmitted through the air-permeable member 506 from the interior of the semicylindrical member 521 or the interior of the dirty-side casing 530, i.e., the transmitted sound, flows into the sound shielding chamber 507. The transmitted sound which flowed in is reflected by the sound-shielding wall portion 304, the air-permeable member 506, the sound shielding ribs 302 which compartmentalize the sound shielding chamber 507. At the time of reflection; the energy of the transmitted sound is absorbed. As a result of this absorption, the transmitted sound is attenuated. The transmitted sound thus attenuated flows from the sound shielding chamber 507 to outside the dirty-side casing 530 through the communicating holes 508.

According to the intake apparatus 501 of this embodiment, it is possible to suppress not only the intake sound but also the transmitted sound. In addition, according to the intake apparatus 501 of this embodiment, the space for installing the sound shielding chamber can be made small as compared with the case where sound shielding chambers are disposed in the respective-members of the air cleaner 503, the intake duct 502, and the air cleaner hose 504. Further, as compared with the case where the sound shielding chambers are disposed in the respective members, the internal configurations of the respective members can be simplified. In addition, the number of component parts can be small as compared with the case where the sound shielding chambers are disposed in the respective members.

In addition, according to the intake apparatus 501 of this embodiment, the multiplicity of small communicating holes 508 are interspersed. For this reason, the transmitted sound in the light shielding chamber 507 is easily reflected by the sound shielding wall portion 304. In this respect, the intake apparatus 501 of this embodiment has a high transmitted-sound suppressing effect.

(11) Eleventh Embodiment

The difference between an eleventh embodiment and the tenth embodiment lies in that a reinforcing rib projects from the inner surface of the sound-shielding wall portion to the rear surface of the air-permeable member. Therefore, a description will be given herein of only the difference.

Figure 20:
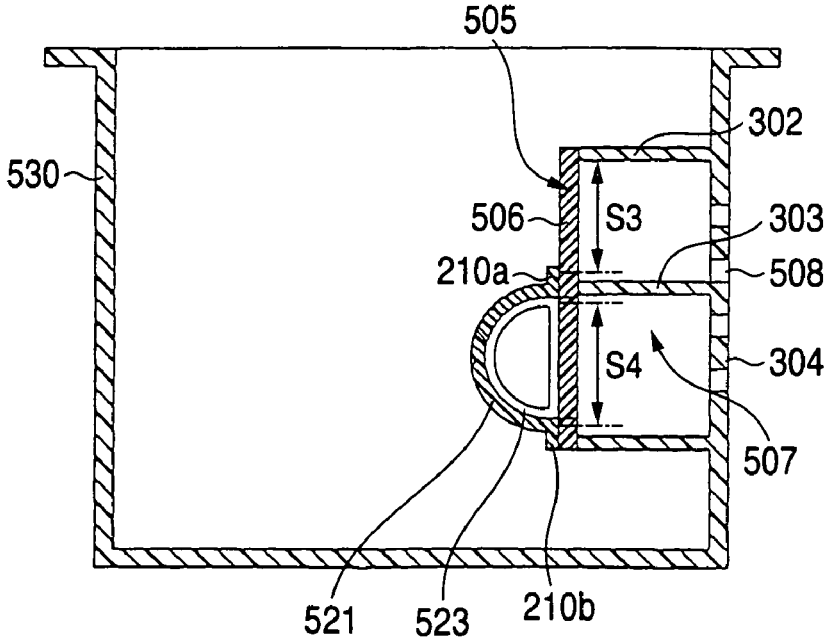
FIG. 20 is a cross-sectional view of the dirty-side casing of the intake apparatus in accordance with an eleventh embodiment.

FIG. 20 shows a cross-sectional view of the dirty-side casing of the intake apparatus in accordance with this embodiment. It should be noted that portions corresponding to those of FIG. 19 will be denoted by the same reference numerals. As shown in the drawing, a reinforcing rib 303 projects from the inner surface of the sound-shielding wall portion 304. The air-permeable member 6 is welded to a distal end face of the reinforcing rib 303.

The intake apparatus 501 of this embodiment exhibits effects similar to those of the intake apparatus of the tenth embodiment. In addition, the intake apparatus 501 of this embodiment has the reinforcing rib 303. For this reason, it is possible to suppress a situation in which the air-permeable member 506 itself flutters and constitutes a new source of noise.

(12) Twelfth Embodiment

The difference between a twelfth embodiment and the tenth embodiment lies in that communicating slits are provided instead of the communicating holes. Therefore, a description will be given herein of only the difference.

Figure 21:
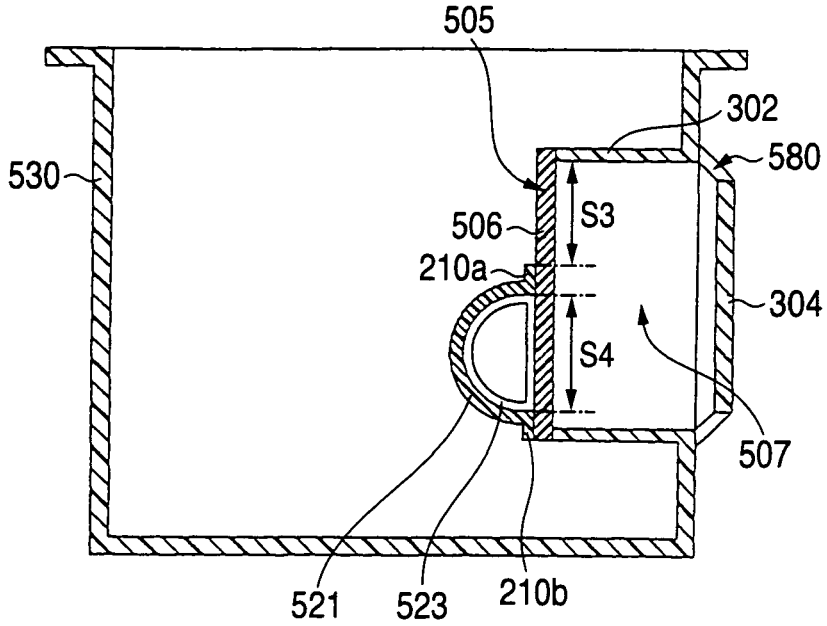
FIG. 21 is a cross-sectional view of the dirty-side casing of the intake apparatus in accordance with a twelfth embodiment.
Figure 22:
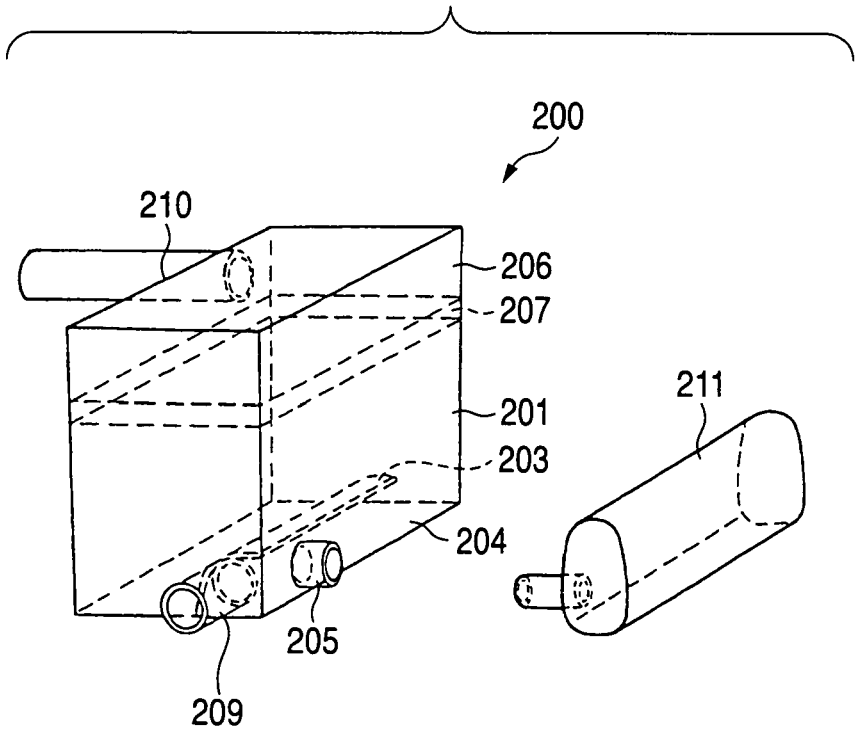
FIG. 22 is a schematic diagram of an air cleaner and its vicinities of a conventional intake apparatus.
Figure 23:
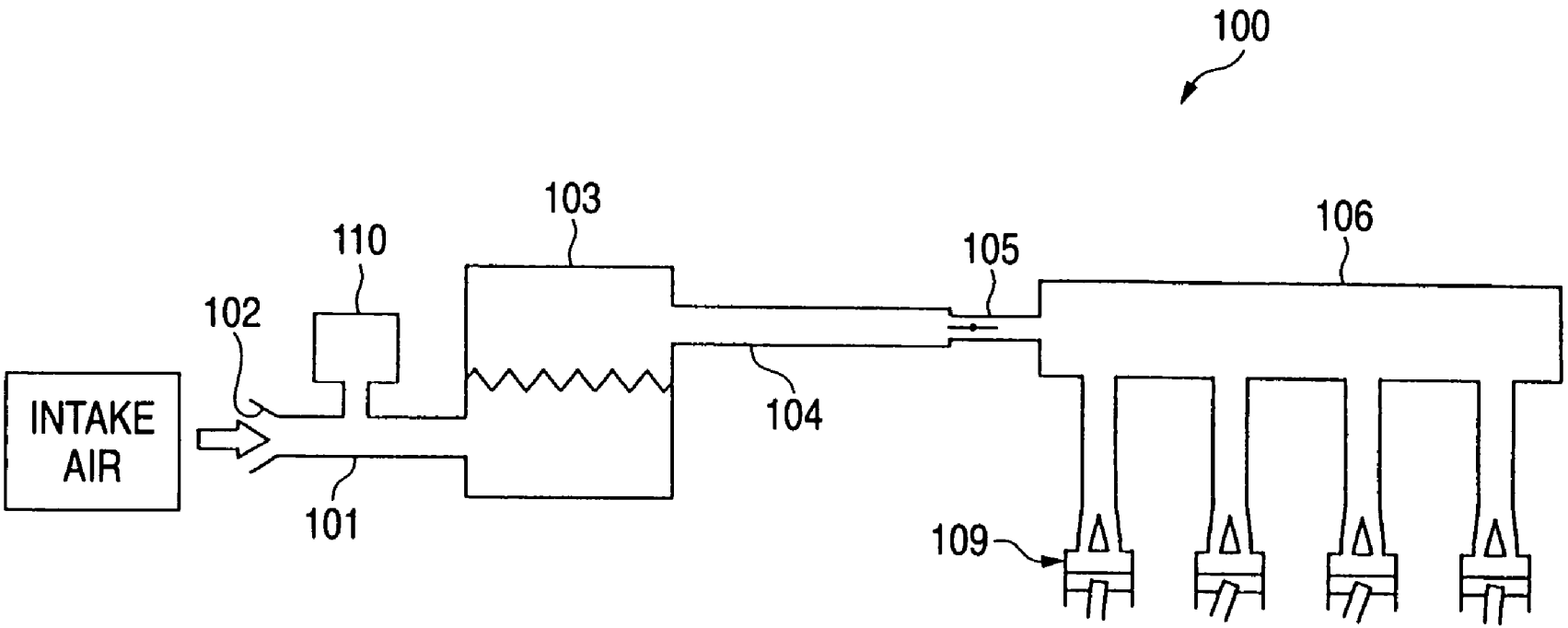
FIG. 23 is a schematic diagram of a conventional intake apparatus.
Figure 24:
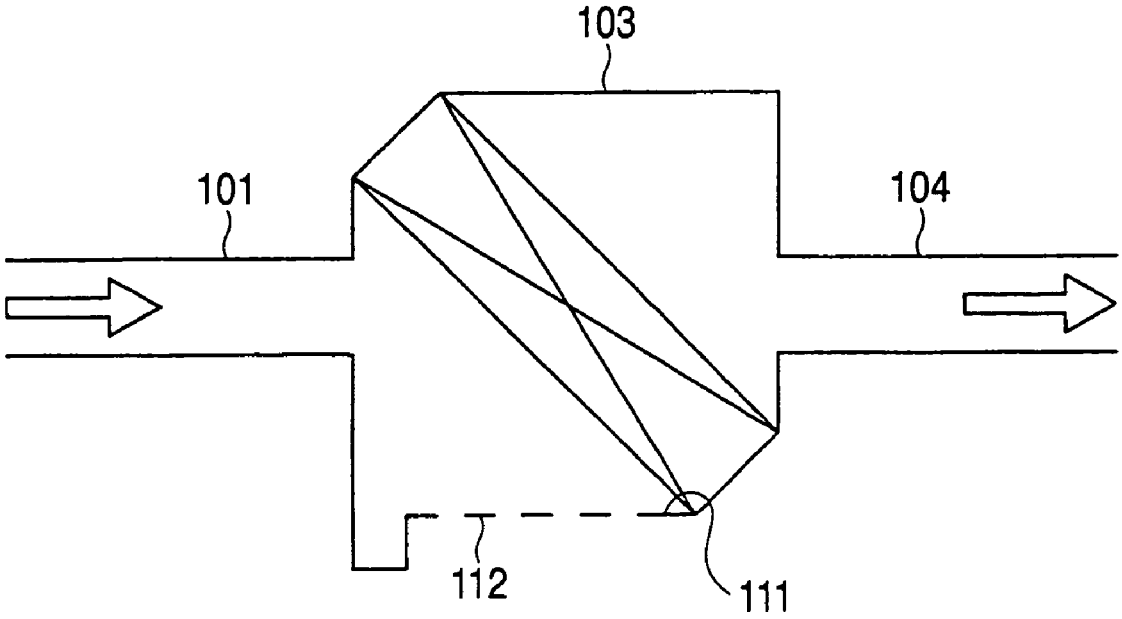
FIG. 24 is a schematic diagram of a conventional air cleaner.
Figure 25:
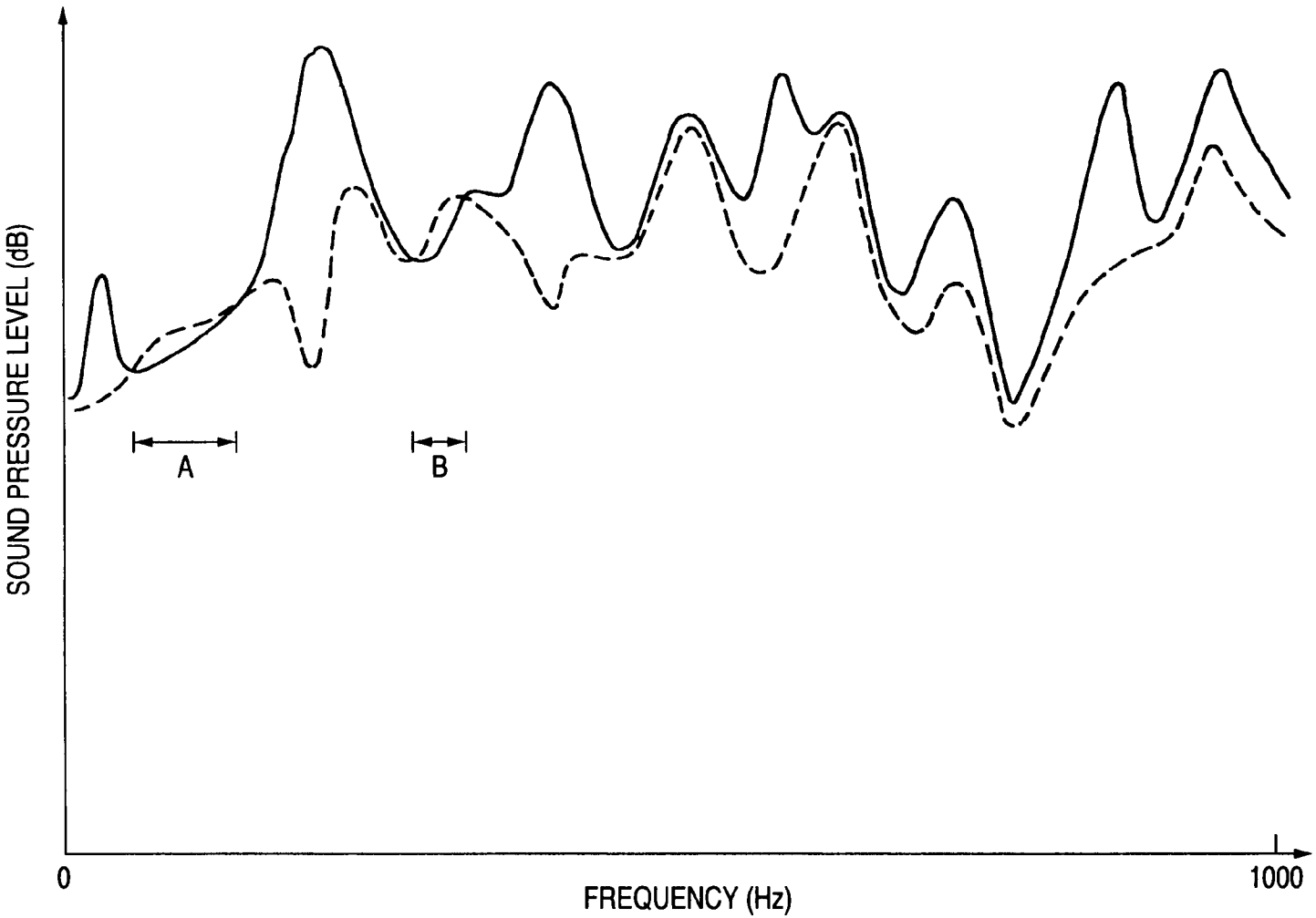
FIG. 25 is a graph showing the frequency distribution of the intake sound and the transmitted sound of the conventional intake apparatus.

FIG. 21 shows a cross-sectional view of the dirty-side casing of the intake apparatus in accordance with this embodiment. It should be noted that portions corresponding to those of FIG. 19 will be denoted by the same reference numerals. As shown in the drawing, the sound-shielding wall portion 304 is provided in such a manner as to project from the dirty-side casing 530. The sound-shielding wall portion has the shape of a rectangular plate. Communicating slits 580 are respectively cut at the four side edges of the sound-shielding wall portion 304. The communicating slits 580 are included among the communicating ports of the invention. The communicating slits 580 allow the sound shielding chamber 507 to communicate with the outside.

The communicating ports are not provided directly in the sound-shielding wall portion 304 of the intake apparatus 1 of this embodiment. The intake apparatus 501 of this embodiment exhibits effects similar to those of the intake apparatus of the tenth embodiment. In addition, as compared with the case where the communicating slits 580 are provided directly in the sound-shielding wall portion 304, the cross-sectional area of each communicating slit 580 can be set to be relatively large.

(13) Others

The embodiments of the intake apparatus in accordance with the invention have been described above. However, the embodiments are not particularly limited to the above-described forms. The invention may be practiced in various modified forms or improved forms which may be implemented by those skilled in the art.

For example, in the above-described embodiments, the dirty-side casing and the clean-side casing are formed of PP with talc mixed in. However, the material of the dirty-side casing and the clean-side casing is not particularly limited. For example, the dirty-side casing and the clean-side casing may be formed of PP with talc-glass fibers mixed in.

In addition, in the above-described embodiments, the air-permeable member is formed of the PET nonwoven fabric. However, the material of the air-permeable member is not particularly limited. For example, the air-permeable member may be formed of a PP nonwoven fabric or a polyamide (PA) nonwoven fabric. Further, the material of the air-permeable member is not limited to the nonwoven fabric, and may be formed of a PET woven fabric, a PP woven fabric, PA woven fabric, or cotton. Furthermore, the air-permeable member may be formed of a urethane-based open-cell sponge or an ethylene-propylene-diene monomer (EPDM)-based open-cell sponge. Still alternatively, filter paper may be used.

In addition, in the above-described embodiments, the air cleaner hose is formed of CR. However, the material of the air cleaner hose is not particularly limited. For example, the air cleaner hose may be formed of such as a blended material of acrylonitrile-butadiene rubber (NBR) and polyvinyl chloride (PVC), a blended material of EPDM, NBR, and EPDM, or a Santoprene (tradename) elastomer.

In addition, in the above-described embodiments, the intake duct is formed of PP. However, the intake duct may be formed of, for example, polyethylene (PE) or the like.

In addition, the method of joining the air-permeable member and the intake duct, the air-permeable member and the dirty-side casing, the air-permeable member and the clean-side casing, or the air-permeable member and the air cleaner hose is not particularly limited. For example, joining may be effected by a welding method such as hot plate welding, vibration welding, or ultrasonic welding. Still alternatively, joining may be effected by an adhesive agent. Furthermore, joining may be effected by insert molding the air-permeable member at the time of injection molding each of the aforementioned members.

Furthermore, the layout positions, the numbers, and the shapes of the transmission port and the air-permeable member are not particularly limited. For example, a plurality of transmission ports may be formed in one member.

In addition, the method of joining the air-permeable member to the air cleaner is not particularly limited. For example, the air-permeable member may be joined to the air cleaner by a welding method such as hot plate welding, vibration welding, or ultrasonic welding. Still alternatively, joining may be effected by an adhesive agent. Furthermore, the layout positions, the numbers, and the shapes of the transmission port and the air-permeable member are not particularly limited.

In addition, although in the tenth and eleventh embodiments the small communicating holes are uniformly distributed in the sound-shielding wall portion of the dirty-side casing, the distribution of the communicating holes may be nonuniform. Further, the shape, size, and the like of each communicating hole are not particularly limited. If the areas of the communicating holes 8 become large, the intake sound becomes small. Conversely, however, the transmitted sound becomes large. The distribution, shapes, sizes, and the like of the communicating holes may be set appropriately by taking into consideration the balance between the intake sound and the transmitted sound.

Figure 8:
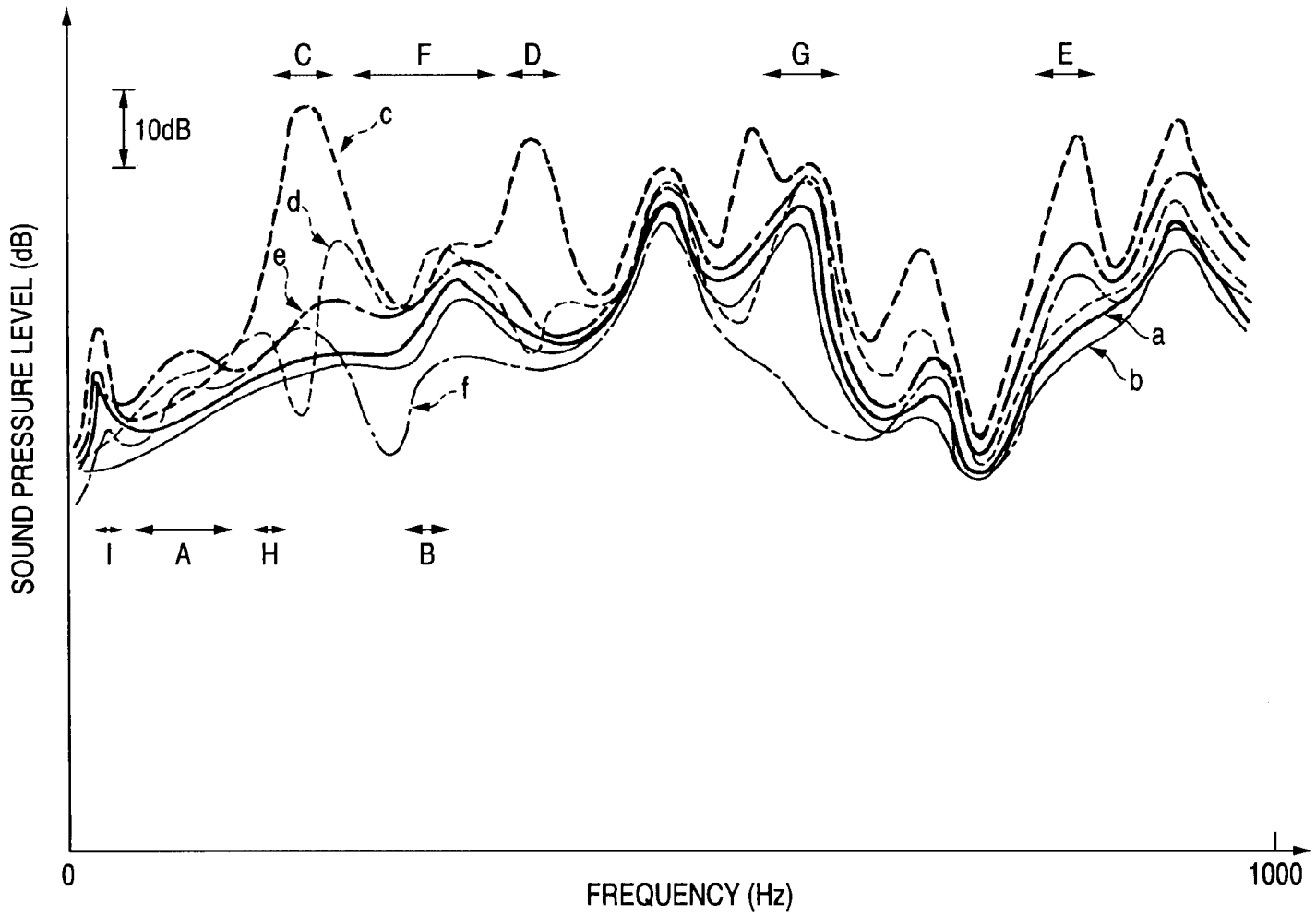
FIG. 8 is a graph showing the frequency distribution of the intake sound and the transmitted sound of the intake apparatus in accordance with the first embodiment.

Hereafter, with reference to FIG. 1 already referred to, a description will be given of an experiment conducted by using the intake apparatus of the first embodiment. FIG. 8 shows the frequency distribution of the intake sound and the transmitted sound. It should be noted that, as for this frequency distribution, white noise was generated from a speaker disposed on the downstream side of the intake manifold 7, and measurement was effected by sampling the intake sound by a microphone disposed on the upstream side of the inlet port 20 and by sampling the transmitted sound by a microphone disposed on the outer side of the air-permeable member 8*b*. Incidentally, the thickness of the air-permeable member 8*a* was set to 2.5 mm. Further, the amount of air permeation of the air-permeable member 8*a* was set so as to become 4 ($m^3$/h) at the time of 98 Pa. Meanwhile, the thickness of the air-permeable member 8*b* was set to 2.0 mm. Further, the amount of air permeation of the air-permeable member 8*b* was set so as to become 2.6 ($m^3$/h) at the time of 98 Pa. It should be noted that the actual amount of air permeation differs slightly from a set value since the pulsation pressure of the intake air is higher on the downstream side than on the upstream side. In addition, the thickness of the air-permeable members 8*a* and 8*b* is adjusted as the thickness of a PET nonwoven fabric having a raw fabric weight of 840 g/$m^2$ and a raw fabric thickness (before hot press) of 5 mm is changed by hot-press forming. The greater the thickness, the greater the amount of air permeation. On the other hand, the smaller the thickness, the smaller the amount of air permeation.

In the drawing, the abscissa indicates the frequency (Hz). In addition, in the drawing, the ordinate indicates the sound pressure level (dB). In addition, in the drawing, the thick solid line a indicates the intake sound of the intake apparatus 1 of the first embodiment. In addition, in the drawing, the thin solid line b indicates the transmitted sound of the intake apparatus 1 of the first embodiment. It should be noted that, as for the transmitted sound, the transmitted sound whose measured value was greater is plotted in the graph.

In addition, in the drawing, the thick dotted line c indicates the intake sound in a case where the single air-permeable member 8*b* was disposed in the dirty-side casing 40 of the air cleaner 4 (this corresponds to the solid line in FIG. 11 referred to before). In addition, in the drawing, the thin dotted line d indicates the transmitted sound in a case where the single air-permeable member 8*b* was disposed in the dirty-side casing 40 of the air cleaner 4 (this corresponds to the dotted line in FIG. 11 referred to before).

In addition, in the drawing, the thick chain line e indicates the intake sound in a case where the single air-permeable member 8*a* was disposed in the intake duct 2. In addition, in the drawing, the thin chain line f indicates the transmitted sound in a case where the single air-permeable member 8*a* was disposed in the intake duct 2.

As shown in the drawing, in the case where the single air-permeable member 8*b* is disposed in the dirty-side casing 40 of the air cleaner 4, frequency ranges in which the sound pressure of the transmitted sound (thin dotted line d) is greater than the sound pressure of the intake sound (thick dotted line c) occur as in the frequency ranges A and B. In addition, if all the frequency ranges of the intake sound and the transmitted sound are viewed, fluctuations of the sound pressure are large in both the transmitted sound and the intake sound. In addition, frequency ranges in which the sound pressure of the transmitted sound is excessively small with respect to the sound pressure of the intake sound occur as in the frequency ranges C, D, and E.

Here, if an attempt is made to effect tuning such that the sound pressure of the intake sound becomes substantially equal to or greater than the sound pressure of the transmitted sound, it is necessary to provide a setting such that the sound pressure of the transmitted sound becomes equal to or less than the sound pressure of the intake sound in the frequency ranges A and B. For this reason, it is necessary to make small the amounts of air permeation of the air-permeable members 8*a* and 8*b*. However, if the amount of air permeation is made small, the sound pressure of the intake sound becomes large. Therefore, frequency ranges in which the sound pressure of the transmitted sound is excessively small with respect to the sound pressure of the intake sound increase as in the frequency ranges C, D, and E.

In the case where the single air-permeable member 8*b* is thus disposed in the dirty-side casing 40 of the air cleaner 4, tuning is restricted to the frequency ranges A and B in which the sound pressure of the transmitted sound becomes greater than the sound pressure of the intake sound. Hence, it can be understood that the allowance for tuning is practically nil.

On the other hand, as shown in the drawing, in the case where the single air-permeable member 8*a* is disposed in the intake duct 2, a frequency range in which the sound pressure of the transmitted sound (thin chain line f) is greater than the sound pressure of the intake sound (thick chain line e) does not occur. However, a frequency range in which the sound pressure of the transmitted sound and the sound pressure of the intake sound are substantially equal occurs as in the frequency range H. In addition, if all the frequency ranges of the intake sound and the transmitted sound are viewed, fluctuations of the sound pressure are large in both the transmitted sound and the intake sound. In addition, frequency ranges in which the sound pressure of the transmitted sound is excessively small with respect to the sound pressure of the intake sound occur as in the frequency ranges F and G.

Here, even if an attempt is made to effect tuning such that the sound pressure of the intake sound becomes substantially equal to or greater than the sound pressure of the transmitted sound, the sound pressure of the transmitted sound and the sound pressure of the intake sound are already substantially equal in the frequency range H. For this reason, if the sound pressure of the transmitted sound is increased to the vicinity of the sound pressure of the intake sound in the frequency ranges F and G, there is a possibility that the sound pressure of the transmitted sound becomes greater than the sound pressure of the intake sound in the frequency range H. Accordingly, tuning cannot be effected in the direction in which the sound pressure of the transmitted sound is made large. On the other hand, if tuning is effected in the direction in which the sound pressure of the transmitted sound is made small, frequency ranges in which the sound pressure of the transmitted sound is excessively small with respect to the sound pressure of the intake sound increase as in the frequency ranges F and G.

In the case where the single air-permeable member 8*a* is thus disposed in the intake duct 2, tuning is restricted to the frequency range H in which the sound pressure of the transmitted sound and the sound pressure of the intake sound are substantially equal. Hence, it can be understood that the allowance for tuning is practically nil.

In contrast to the above-described case where a single air-permeable member is disposed, in the case of the intake apparatus 1 of the first embodiment, a frequency range in which the sound pressure of the transmitted sound (thin solid line b) becomes greater than the sound pressure of the intake sound (thick solid line a) does not occur. In addition, if all the frequency ranges of the intake sound and the transmitted sound are viewed, fluctuations of the sound pressure are small in both the transmitted sound and the intake sound. Further, the sound pressure of the intake sound falls within a range of the sound pressure of the transmitted sound to the sound pressure of the transmitted sound +3 dB in all frequency ranges other than the frequency range I.

Namely, according to the intake apparatus 1 of the first embodiment, it can be understood that tuning is effected such that the sound pressure of the intake sound is substantially equal to or greater than the sound pressure of the transmitted sound. Accordingly, it can be appreciated that both the noise outside the vehicle and the noise inside the vehicle are small.

A description has been given above of the experiment using the intake apparatus of the first embodiment. In this experiment, a description has been given of the case where tuning is effected such that the sound pressure of the intake sound becomes substantially equal to or greater than the sound pressure of the transmitted sound.

However, even in a case where the sound pressure of the transmitted sound and the sound pressure of the intake sound are tuned into a balance other than that of this experiment, the intake apparatus of the first embodiment is more advantageous than the intake apparatus having a single air-permeable member.

For example, in a case where tuning is effected such that the sound pressure of the transmitted sound becomes greater than the sound pressure of the intake sound, in the case of the intake apparatus in which the single air-permeable member 8*b* is disposed in the dirty-side casing 40, frequency ranges in which the sound pressure of the transmitted sound is excessively small with respect to the sound pressure of the intake sound are present as in the frequency ranges C, D, and E. In these frequency ranges, if tuning is effected such that the sound pressure of the transmitted sound becomes greater than the sound pressure of the intake sound, the sound pressure of the transmitted sound becomes excessively larger than the sound pressure of the intake sound in the frequency ranges A and B where the sound pressure of the transmitted sound is essentially greater than the sound pressure of the intake sound.

Meanwhile, in the case where tuning is effected such that the sound pressure of the transmitted sound becomes greater than the sound pressure of the intake sound, in the case of the intake apparatus in which the single air-permeable member 8*a* is disposed in the intake duct 2, frequency ranges in which the sound pressure of the transmitted sound is excessively small with respect to the sound pressure of the intake sound are present as in the frequency ranges F and G. In these frequency ranges, if tuning is effected such that the sound pressure of the transmitted sound becomes greater than the sound pressure of the intake sound, the sound pressure of the transmitted sound becomes excessively larger than the sound pressure of the intake sound in the frequency range H where the sound pressure of the transmitted sound and the sound pressure of the intake sound are substantially equal.

In contrast to the above-described case where the single air-permeable member is disposed, in the case of the intake apparatus 1 of the first embodiment, a frequency range in which the sound pressure of the transmitted sound becomes greater than the sound pressure of the intake sound is not present. In addition, if all the frequency ranges of the intake sound and the transmitted sound are viewed, fluctuations of the sound pressure are small in both the transmitted sound and the intake sound. Further, the sound pressure of the intake sound falls within a range of the sound pressure of the transmitted sound to the sound pressure of the transmitted sound +3 dB in all frequency ranges other than the frequency range I. Therefore, it is possible to effect tuning such that the sound pressure of the transmitted sound becomes greater than the sound pressure of the intake sound while establishing a balance between the sound pressure of the transmitted sound and the sound pressure of the intake sound.

It should be noted that, as a case where tuning is effected such that the sound pressure of the transmitted sound becomes greater than the sound pressure of the intake sound, it is possible to cite a case where the sound insulation of the engine compartment is high, and the noise inside the vehicle does not become large even if the sound pressure of the transmitted sound is increased.

According to the invention, it is possible to provide an intake apparatus which is capable of tuning the sound pressure of the intake sound and the sound pressure of the transmitted sound over a wide frequency range, and in which the number of assembling steps is small, and the number of component parts is also small.

Although several embodiments are independently explained in the above, each characteristics of each embodiment can be combined appropriately and realized in one intake apparatus wherever possible as occasion demands. For example, the intake apparatus in accordance with the ninth embodiment is conceived by incorporating the subject matter of the first to sixth embodiments into the seventh embodiment. Similarly, the sound shielding wall portions and the air-permeable members can be provided at not only the side of the intake duct but also the side of the air cleaner hose in the tenth to twelfth embodiments, and amounts of air permeation of the air-permeable members are set so as to be mutually different in order to tune intake sound generated from the inlet port and transmitted sound generated from each of the air-permeable members.

The present invention is not limited to the mode for carrying out the invention and the embodiment thereof at all, and includes various modifications which can be conceived easily by those skilled in the art, without departing from the scope of claim.

What is claimed is:

1. An intake apparatus comprising:

a tubular intake duct having an inlet port for introducing intake air from an outside;

an air cleaner disposed downstream of said intake duct to filter intake air;

an air cleaner hose disposed downstream of said air cleaner and communicating with a combustion chamber of an engine; and a plurality of transmission ports which are respectively closed by air-permeable members and disposed in at least two members selected from among said intake duct, said air cleaner, and said air cleaner hose;

wherein amounts of air permeation of said air-permeable members are set so as to be mutually different in order to tune intake sound generated from said inlet port and transmitted sound generated from each of said air-permeable members.

2. An intake apparatus according to claim 1, wherein the amounts of the air permeation of said air-permeable members are adjusted so that sound pressure of the intake sound is set to be equal to or one of slightly greater than and slightly less than the sound pressure of the transmitted sound.

3. An intake apparatus according to claim 2, wherein the sound pressure of the intake sound is set to be equal to or slightly greater than the sound pressure of the transmitted sound.

4. An intake apparatus according to claim 3, wherein the sound pressure of the intake sound is set to fall within a range of the sound pressure of the transmitted sound to the sound pressure of the transmitted sound +3 dB.

5. An intake apparatus according to claim 2, wherein said transmission ports are respectively disposed in said intake duct and a dirty side of said air cleaner.

6. An intake apparatus according to claim 2, wherein the amounts of air permeation of said air-permeable members are set such that the amount of air permeation of said air-permeable member disposed on an upstream side becomes greater than the amount of air permeation of said air-permeable member disposed on a downstream side.

7. An intake apparatus according to claim 1, further comprising a cleaner-incorporated member being accommodated in said air cleaner, said cleaner-incorporated member having one end communicating with one of said intake duct and said air cleaner hose in such a maimer as to be separated from an interior of said air cleaner and another end which is open in the interior of said air cleaner, wherein an outer wall of said air cleaner is formed by a dual-use outer wall portion which also serves as an outer wall of said cleaner-incorporated member as well as an exclusive-use outer wall portion for forming only said air cleaner, and the outer wall of said air cleaner has at least one transmission port which is formed in such a maimer as to extend over the dual-use outer wall portion and the exclusive-use outer wall portion, and which is closed by said air-permeable member.

8. An intake apparatus according to claim 7, wherein said cleaner-incorporated member is a semicylindrical member obtained by half-splitting a tubular member in an axial direction, one axial end of said semicylindrical member communicates with one of said intake duct and said air cleaner hose in such a manner as to be separated from the interior of said air cleaner, and another axial end thereof is open in the interior of said air cleaner.

9. An intake apparatus according to claim 8, wherein said semicylindrical member is welded and fixed to the dual-use outer wall portion and said air-permeable member.

10. An intake apparatus according to claim 7, further including a sound shielding wall spaced apart from said air-permeable member closing said transmission port.

11. An intake apparatus according to claim 1, further comprising:

a cleaner-incorporated member having one end communicating with one of said intake duct and said air cleaner hose in such a manner as to be separated from an interior of said air cleaner and another end which is open in the interior of said air cleaner;

a sound shielding wall portion formed integrally with an outer wall of said air, cleaner to compartmentalize a sound shielding chamber on an inner side thereof; and a communicating port for allowing said sound shielding chamber and an outside of said air cleaner to communicate with each other;

wherein said transmission port allows said sound shielding chamber to communicate with the interior of said air cleaner and an interior of said cleaner-incorporated member, and closed by said air-permeable member.

12. An intake apparatus according to claim 11, wherein said transmission port is formed in said sound-shielding wall portion.

13. An intake apparatus according to claim 11, wherein said cleaner-incorporated member is a half-split member obtained by half-splitting a tubular member in an axial direction, one axial end of said half-split member communicates with one of said intake duct and said air cleaner hose in such a manner as to be separated from the interior of said air cleaner, and another axial end thereof is open in the interior of said air cleaner.

14. An intake apparatus comprising:

a tubular intake duct having an inlet port for introducing intake air from an outside;

an air cleaner disposed downstream of said intake duct to filter intake air;

an air cleaner hose disposed downstream of said air cleaner and communicating with a combustion chamber of an engine; and a cleaner-incorporated member being accommodated in said air cleaner, said cleaner-incorporated member having one end communicating with one of said intake duct and said air cleaner hose in such a manner as to be separated from an interior of said air cleaner and another end which is open in the interior of said air cleaner;

wherein an outer wall of said air cleaner is formed by a dual-use outer wall portion which also serves as an outer wall of said cleaner-incorporated member as well as an exclusive-use outer wall portion for forming only said air cleaner, and the outer wall of said air cleaner has at least one transmission port which is formed in such a manner as to extend over the dual-use outer wall portion and the exclusive-use outer wall portion, and which is closed by an air-permeable member.

15. An intake apparatus comprising:

a tubular intake duct having an inlet port for introducing intake air from an outside;

an air cleaner disposed downstream of said intake duct to filter intake air;

an air cleaner hose disposed downstream of said air cleaner and communicating with a combustion chamber of an engine;

a cleaner-incorporated member having one end communicating with one of said intake duct and said air cleaner hose in such a manner as to be separated from an interior of said air cleaner and another end which is open in the interior of said air cleaner;

a sound shielding wall portion formed integrally with an outer wall of said air cleaner to compartmentalize a sound shielding chamber on an inner side thereof; and a communicating port for allowing said sound shielding chamber and an outside of said air cleaner to communicate with each other;

wherein said transmission port allows said sound shielding chamber to communicate with the interior of said air cleaner and an interior of said cleaner-incorporated member, and closed by an air-permeable member.

* * * * *